US009448042B2

(12) United States Patent
Schill, Jr.

(10) Patent No.: US 9,448,042 B2
(45) Date of Patent: Sep. 20, 2016

(54) DIMINISHING DETONATOR EFFECTIVENESS THROUGH ELECTROMAGNETIC EFFECTS

(71) Applicant: University of Nevada, Las Vegas, Las Vegas, NV (US)

(72) Inventor: Robert A. Schill, Jr., Henderson, NV (US)

(73) Assignee: The Board Of Regents Of The Nevada System Of Higher Education On Behalf Of The University of Nevada, Las Vegas, Las Vegas, NV (US)

( * ) Notice: Subject to any disclaimer, the term of this patent is extended or adjusted under 35 U.S.C. 154(b) by 204 days.

(21) Appl. No.: 13/934,377

(22) Filed: Jul. 3, 2013

(65) Prior Publication Data

US 2016/0209194 A1 Jul. 21, 2016

Related U.S. Application Data

(60) Provisional application No. 61/667,827, filed on Aug. 9, 2012.

(51) Int. Cl.
*F41H 11/136* (2011.01)
*F42D 5/04* (2006.01)

(52) U.S. Cl.
CPC ..... *F41H 11/136* (2013.01); *F42D 5/04* (2013.01)

(58) Field of Classification Search
CPC ..... F41H 11/136; F42D 5/04; F42B 33/065; F42B 33/067
USPC ..... 89/1.11, 1.13
See application file for complete search history.

(56) References Cited

U.S. PATENT DOCUMENTS 2,578,263 A * 12/1951 Perkins ..... 307/108
7,775,146 B1 * 8/2010 Bitar et al. ..... 89/1.13
7,987,760 B1 * 8/2011 Lundquist et al. ..... 89/1.13

FOREIGN PATENT DOCUMENTS

EP 305 556 * 3/1989

* cited by examiner

*Primary Examiner* — Stephen M Johnson
(74) *Attorney, Agent, or Firm* — Ballard Spahr LLP

(57) ABSTRACT

An inductively coupled transmission line with distributed electromotive force source and an alternative coupling model based on empirical data and theory were developed to initiate bridge wire melt for a detonator with an open and a short circuit detonator load. In the latter technique, the model was developed to exploit incomplete knowledge of the open circuited detonator using tendencies common to all of the open circuit loads examined. Military, commercial, and improvised detonators were examined and modeled. Nichrome, copper, platinum, and tungsten are the detonator specific bridge wire materials studied. The improvised detonators were made typically made with tungsten wire and copper (~40 AWG wire strands) wire.

5 Claims, 16 Drawing Sheets

PSpice Model Picture

DIMINISHING DETONATOR EFFECTIVENESS THROUGH ELECTROMAGNETIC EFFECTS

RELATED APPLICATIONS DATA

This application claims priority from U.S. provisional Patent Application Ser. No. 61/667,827, filed 9 Aug. 2012.

GOVERNMENT CONTRACT NOTICE

This invention was made with government support under DE-AC32-06NA2594 awarded by the Department of Energy. The government has certain rights in the invention.

BACKGROUND OF THE INVENTION

1. Field of the Invention

The present invention relates to the field of detonators for explosive or blasting environments and particularly apparatuses and methods for deactivating or reducing the performance characteristics of detonators in order to reduce the intentional or accidental initiation of an event by triggering the detonator.

2. Background of the Art

Most modem explosive events are electrically or electronically triggered. The detonation system typically comprises an available electrical power source, activation circuitry, an electrical bridge wire between the power source and the explosive material. The explosive event is initiated by passing current through the bridge wire to initiate the explosive event or trigger an initiator which in turn triggers the explosive event. For example, pulsed current can vaporize the oxidation of aluminum as part of a detonation system.

It is an unfortunate characteristic of these times that explosive devices may be present in many different environments. Legal explosive devices using detonators may be present in construction projects, drilling or mining projects, demolition projects, and military projects. Unlawful use of explosives may occur in criminal activity, terrorist activity, and other such events.

It is often desirable to deactivate explosive devices or even detonate those devices under controlled action. Explosive devices can be detonated safely only under such controlled conditions; even then, the controlled conditions may be marginal because of the sensitive nature of explosive devices. That is, it is difficult to move, transport, manipulate or physically act on an explosive device that is suspected of being capable of intentional or accidental detonation.

Some detonators are activated by movement (e.g., mercury switches), timing devices, distal signaling devices (e.g., phones, microwaves, RF transmission, or magnetic response) and the like. As the mechanism for detonation may be unknown or may be known or feared to be unstable, detonation is usually problematic as the conditions cannot always be fully controlled.

It is desirable to create a greater level of control in the environment of explosive deactivation or neutralization by addressing the detonator element itself. If the detonator itself were disabled, destroyed, or reduced in terms of the effectiveness of performance, the control over the explosive environment is greatly enhanced. Even though the explosives may accidentally or intentionally be detonated, that probability is reduced by addressing the functionality of the detonator.

SUMMARY OF THE INVENTION

The present technology relates to methods, apparatuses, and systems for reducing the functionality of explosive devices having a detonator and a wire in the detonator without primary contact with an explosive device by personnel. The method includes reducing the performance characteristics of a detonator for an explosive device. Steps may include:

1. Directing electromagnetic energy at the detonator;
2. Continuing direction of the electromagnetic energy at the detonator at a fluence or flow rate, frequency, and duration sufficient to cause Joule heating of a wire within the detonator; and
3. The Joule heating causing a diminution of the electrical transmission capability of the wire sufficient to reduce the performance characteristics of the detonator.

Typically, the targeted wire is a bridge wire in the detonator, but may also be any other functional wire component including an antenna pick-up or isolated/non-isolated electronic circuitry load attached to the detonator. Typically, the wire comprises a metal, alloy, composite wire, or of a semiconducting material. Diminution of the performance characteristics of the wire is effected by changing the electrical resistance of the wire, up to and including severance of the wire so that it effectively has infinite resistance. The change in the electrical resistance may be caused by melting or vaporizing at least a portion of the material in the wire or by altering a phase, state, or persistent condition of the wire. Even heating a wire with a single pulse may at least double its resistance. A typical fluence goal is directed at a pulse that is frequency rich with constant spectral amplitude over the entire frequency range with the exclusion of the DC and near DC components. Further, in the time domain, the spectral frequency components need to be sustained over the time needed for wire melt. The method may include the pulse being tuned to a specific wire configuration by imposition of a specific pulse characteristic comprising at least two characteristics selected from the following group: frequency, intensity, rise time, pulse duration, duty cycle, pulse width, damped resonant nature, pulse shaping, and pulse modulation. The frequency of the pulse may be varied over a range of at least one-tenth or at least one-half order of magnitude during duration of the pulse. The pulse may be at least 5 kV or at least 10 kV over duration of the pulse. The pulse may generate a flow of at least 50 A or at least 100 A through the wire.

DETAILED DESCRIPTION OF THE INVENTION

Figure 1A:
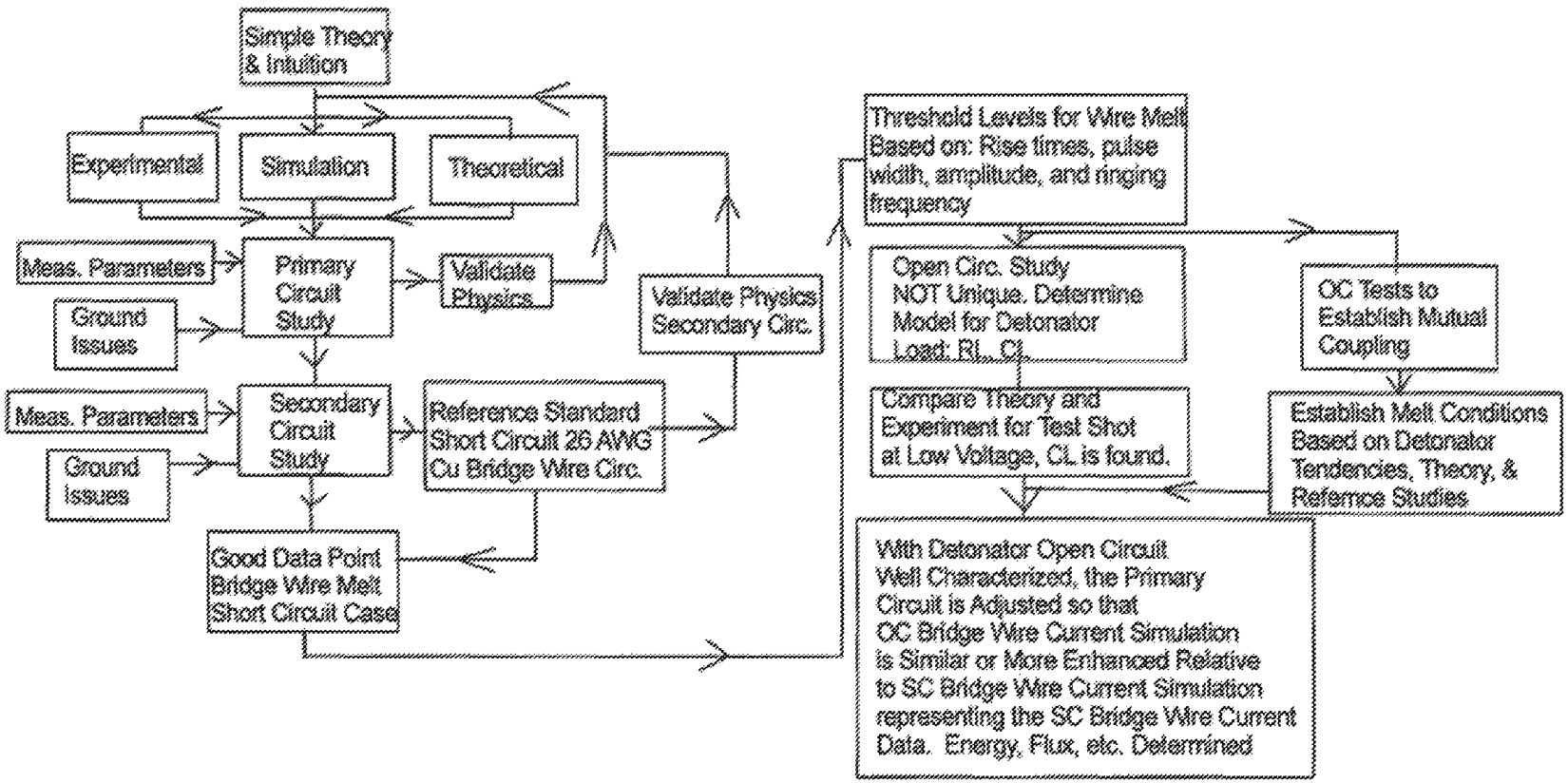
FIG. 1A provides a block diagram that illustrates the path taken ultimately to address the objective of the research effort.

The present technology relates to methods, apparatuses, and systems for reducing the functionality of explosive devices having a detonator and a wire in the detonator without primary contact with an explosive device by personnel. The methods include reducing the performance characteristics of a detonator for an explosive device. Steps may include:

1. Directing electromagnetic energy at the detonator;
2. Continuing direction of the electromagnetic energy at the detonator at a fluence or flow rate, frequency and duration sufficient to cause Joule heating of a wire within the detonator; and
3. The Joule heating causing a diminution of the electrical transmission capability of the wire sufficient to reduce the performance characteristics of the detonator.

Theories and experiments were developed to study the initiation of bridge wire melt for a detonator with an open and a short circuit detonator load. Military, commercial, and improvised detonators were examined and modeled. Nichrome, copper, platinum, and tungsten are the detonator-specific bridge wire materials studied. Even so, the findings are directly applicable to any wire, for example, metals, alloys, composites, semiconductors, etc. that are capable of resistive heating, melting, vaporization, oxidation, state change, phase change and the like) in response to electromagnetic pulsing. The improvised detonators typically were made with tungsten wire and copper (~40 AWG wire strands) wire. Excluding the improvised tungsten bridge wires, short circuited detonators with a 1" square loop where consistently melted in a laboratory setting with modest capacitor voltages. Although the tungsten wire rarely melted, the bridge wire would yield dull visible glows to bright flashes that indicate the wire did reach temperatures believed to be hot enough to activate explosive material. A lumped contact resistance was fabricated to account for the extra significant resistance measured that could not be accounted for based on bridge wire geometry and material property. Good agreement between theory and experiment were shown. A baseline reference study was performed on bridge wire-free detonators terminated in various open circuit configurations (i.e., twisted pair, parallel wire, etc.). With the aid of short circuit detonator melt tests, reference bridge wire-free detonator tests with open circuit loads, and theory, scaling laws were determined to predict bridge wire melt conditions in detonators terminated in various open circuited wire loads constrained to be an inch long. Experimental bridge wire melt studies on detonators loaded with one inch long parallel wires with a 2 mm distance of separation, terminated with an open circuit tend to support the scaling laws for wire melt.

The overall activities in this disclosure have focused on: 1. Short circuited detonators with lead wires having an approximate 1 inch square inductive coupling {Faraday coupling} area; 2. Open circuited detonator loads with 1 inch long lead wires separated by no more than 2 mm in a parallel wire or helical wire configuration. These limitations merely define the specifics of the study. They are not intended to and do not limit the scope of the generic nature of the technology. These are merely the ranges focused upon in the analyses and experiments. The disclosure indicates what threshold conditions are required to couple pulsed electromagnetic energy of any form into the constrained detonator circuits to cause explosive detonation, open circuit disconnect, and/or deflagration.

Pulsed power is rich in frequency content. Low frequency waves have the potential for greater depth of penetration but low inductive coupling. High frequency waves have the ability to inductively couple more energy in non-electrically connected circuits but their depth of penetration is smaller. This is not a resonant based technology therefore the technique is not detonator geometry and detonator material specific. It is a general technology that may be extended to the resonant condition if desired. This is not a wave concept therefore there is no difficulty in fitting the energy into a shielded box and no concern with non-uniform coverage resulting from standing waves generating hot and cold spots. Further, there is no need for developing elaborate scanning strategies in a shielding environment. The pulsed power technique employed is a quasi-static concept where the fields are specifically tied to the source. This makes the field profile to be both source geometry and external medium specific allowing for more control on the profile. For those steeped in antenna theory, field coupling takes place in the reactive near-field region. Because the pulse power technique is frequency rich excluding DC and near DC frequencies and typically middle to high microwave frequencies (microwave frequencies extend from 300 MHz to 300 GHz), one can compromise high frequency inductive chokes and very low frequency electrostatic discharge features designed in some military and possibly commercial detonators. The pulsed power technique is a simple concept and, potentially, relatively inexpensive to design and build with a certain level of power tunability. The pulse profile and shape (e.g., rise time, pulse duration, duty cycle, pulse width, amplitude, damping resonant nature, pulse shaping, modulation, etc.) may be optimized. The ringing nature of the signal may be used to ensure deflagration of explosive material on the detonator. Consequently, energy is not wasted but reused. The generated quasi-static fields are tied to the source and hence the test station. The field amplitude decays rapidly away from the test region. The radiated electromagnetic energy is significantly minimized. Potentially there is minimal to no heating of non-metals. In comparison, microwaves tend to heat water molecules through a process called dielectric heating. Dielectric heating of water may be an undesired energy loss mechanism that is potentially environment dependent. If designed properly, the potential exists for a broad, uniform area of coverage per single pulse, with no probing required Throughout this document, we will continuously use the terminology 'primary circuit' and 'secondary circuit' (equivalently, detonator circuit or reference monitor standard). Further, other equivalent terminology will be interchangeably used to describe the coupling mechanism. For clarity, the terminology used is defined as follows:

- Primary circuit is the circuit that generates the time varying magnetic flux ($L,L_o,R_o,C_o$). Sometimes a subscript 'p' is used to denote primary circuit parameter or measurement.
- Secondary circuit is the detonator circuit or the reference monitor standard that experiences the time varying magnetic flux inducing a voltage [electromotive force (emf)] in the secondary circuit. Sometimes a subscript 's' is used to denote a secondary circuit parameter or measurement. The terms reference and standard are used synonymously.
- Joule heating is heating resulting from power dissipation losses as a consequence of a current passing through a resistor or resistive element.
- Faraday coupling is the same as inductive coupling—magnetic coupling, when used in this document in which a time varying field induces an electromotive force in a non-electrically connected circuit.
- Quasi-static fields typically are fields that are tied to the source that generates the fields.

This implies that the fields in a finite geometry decay faster than the inverse of distance from the source. If the source is turned off, the fields are unable to sustain themselves and therefore must also turn off in a somewhat simultaneous manner. In comparison, an electromagnetic wave dissociates itself from the source and can propagate regardless if the source is on or off. In this case, the fields generated by the finite source, far enough away from the source, decays as one over the distance from the source.

- Bridge wire proper (or just "bridge wire") refers solely to the bridge wire without end effects.
- Detonator or detonator assembly consists of the bridge wire, the detonator posts or bridge wire posts, electrostatic discharge material, associated with the detonator posts, inductive chokes associated with the detonator posts, and the detonator wire leads. Sometimes, the detonator leads are denoted as the detonator wires, the detonator transmission line or transmission line, and/or the detonator load. The bridge wire proper is bonded to the bridge wire posts allowing the posts to support the bridge wire.
- Detonator circuit consists of the detonator assembly with a load connected at the end of the detonator leads. Typically, in this document the only loads of interest are the short circuit and the open circuit loads. The load is on the side of the detonator opposite to the bridge wire side.
- Lumped element is a discrete element independent of spatial dimension.
- Distributed element is an element that is spatially weighted. In the limit that the element of space goes to zero, the weighted element also vanishes. This is a statistical element.
- Contact effects refer to both end effects of the bridge wire and bridge wire inhomogeneities and impurities (non-ideal bridge wire effects)
- Measured bridge wire resistance or bridge wire assembly resistance is the resistance due to the bridge wire proper and that due to contact effects. $R_W$, $R_{BW}$(measured), $R_{BWm}$, $R_{mBW}$, or $R_m$ are symbols used to represent the bridge wire resistance proper plus contact resistance. Typically, the measured bridge wire resistance is measured either at the detonator posts or at the detonator wires. The detonator post resistance is insignificant; therefore, under this condition, the measured bridge wire resistance (bridge wire assembly resistance) equals the detonator resistance. Nondestructive measurements for direct bridge wire resistance versus temperature are difficult to achieve due to the size and delicate nature of the wire.
- Bridge wire resistance or bridge wire resistance proper is the resistance solely due to the bridge wire proper. This resistance is usually calculated based on an ideal cylindrical geometry. Some opportunities are afforded to actually measure the resistance of the improvised wires. The subscript 'BW' is used to represent the bridge wire resistance proper.
- Contact resistance sometimes called the lumped contact resistance is the lumped resistance due to contact bonding, non-ideal wire diameter resulting for example from bends and kinks, metal impurities, etc. $R_c$, and $R_{BW}$ (contact) are the symbols used for the contact resistance. This fabricated resistance captures all of the resistive effects equaling the difference between the measured bridge wire resistance and the bridge wire resistance proper. In general, the temperature of the contact resistance does not equal the temperature of the bridge wire resistance since both materials see the same current. In simulation studies for simplicity or a worst case scenario, this resistance is temperature independent.
- Standard or sensor standard or reference monitor standard is a carefully characterized probe that all measurements are based on. A standard was required to guarantee that all experiments were performed in the same manner and received the same time varying magnetic flux. Based on standard measurements, experimental measurements may be corrected.
- Deflagrate means to consume by burning.

An inductively coupled transmission line with distributed electromotive force source and an alternative coupling model based on empirical data and theory were developed to initiate bridge wire melt for a detonator with an open and a short circuit detonator load. In the latter technique, the model was developed to exploit incomplete knowledge of the open circuited detonator using tendencies common to all of the open circuit loads examined. Military, commercial, and improvised detonators were examined and modeled. Nichrome, copper, platinum, and tungsten are the detonator specific bridge wire materials studied. The improvised detonators were made typically made with tungsten wire and copper (~40 AWG wire strands) wire. Excluding the improvised tungsten bridge wires, short circuited detonators with a 1" square loop where consistently melted in a laboratory setting with modest capacitor voltages. Although the tungsten wire were rarely melted, the bridge wire would yield dull visible glows to bright flashes indicate that the wire did reach temperatures believed to be hot enough to activate explosive material. A lumped contact resistance was fabricated to account for the extra significant resistance measured that could not be accounted for based on bridge wire geometry and material property. This resistance takes into account the loading effects of the contact points between the bridge wire and bridge wire posts and all bridge wire non-uniformities resulting from, for example, mechanical bending and material impurities. Good agreement between theory and experiment were shown. A baseline reference study was performed on bridge wire-free detonators terminated in various open circuit configurations (i.e., twisted pair, parallel wire, etc.). With the aid of short circuit detonator melt tests, reference bridge wire-free detonator tests with open circuit loads, and theory, scaling laws were determined to predict bridge wire melt conditions in detonators terminated in various open circuited wire loads constrained to be an inch long. Experimental bridge wire melt studies on detonators loaded with one inch long, 2 mm distance of separation, parallel wires terminated with an open circuit tend to support the scaling laws for wire melt.

Chart 1, FIG. 1A provides a block diagram that illustrates the path taken ultimately to address the objective of the research effort. Based on measured parameters in experiment, experimental, theoretical, and simulation primary circuit currents were forced to agree in amplitude and phase. Then, experimental, theoretical, and simulation secondary circuit currents with primary circuit corrections were iteratively forced to agree based on measured parameters. A reference monitor sensor standard was required to calibrate the secondary circuit. The reference monitor sensor standard was used throughout all experiments with combined with the detonator circuit to make sure that the field experienced by the detonator circuit was the same as in previous experiments. This allows for correcting non-uniform induced voltages among experiments and for correcting orientation and placement errors of the detonator circuit relative to the coil generating the magnetic flux. The short circuited detonator studies yielded wire melt data for calibration and scaling predictions. Theories and simulations were calibrated and enhanced to describe the physics of the problem. Bridge wire signatures were compared. Other sensors (photodiodes and fast and slow cameras) were also introduced in the study to help clarify the physics. A series of open circuit tests not leading to wire melt were studied to characterize the open circuit load model in the detonator circuit. The primary circuit was not changed. It was anticipate that with a well characterized secondary model for a number of potential realistic open circuit scenarios, the primary circuit could be modified until the currents in the open circuit simulation had a similar signature response as the short circuit simulation representing the observed short circuit melt signatures in experiment. Tendencies common to all of the open circuit loads examined were exploited in the model. This development lead to scaling laws that predicts melting thresholds based on a reference (standard) study. Comparisons are made base on amplitude, ringing frequency, rise time, decay rate, and pulse duration. Open circuit detonator experiments with bridge wire (copper and platinum) were performed to substantiate the predictions from the coupling model.

An induction coupling theory is developed that suitably describes experiments performed in the laboratory that have the potential to melt the bridge wire of detonators without electrical or mechanical contact based on the detonator assembly's ability to capture enough electromagnetic energy fast enough over a sustained amount of time. It is hypothesized that if the theory is designed to describe the experiment and is forced to match the experiment at one data point with parameters consistent with measurement, then the theory should be valid over a large parameter space not necessarily attainable with current resources in the laboratory. Further, it is hypothesized that if one can find an operating point that consistently melts the bridge wire of various styles of commercial/military detonators and improvised electric detonators (IED), then it is likely that all detonators of the same classification will melt, deflagrate, or become hot enough to activate the detonator explosive. The intensity and color of the visible light generated by the bridge wire is another indication of the temperature of the wire.

Figure 1B:
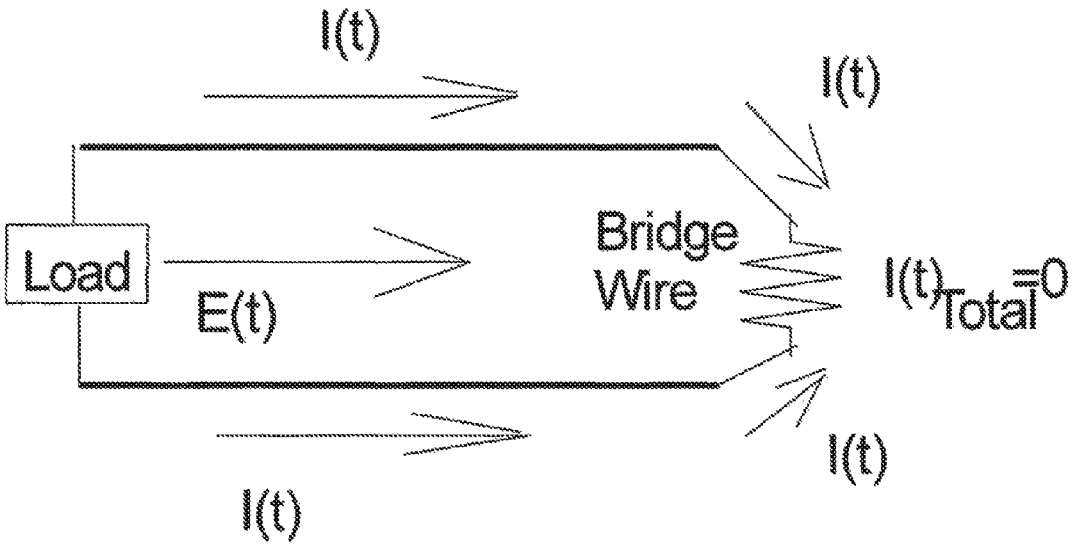
FIG. 1B shows an external field that drives a common current mode which through destructive interference leads to a zero voltage at the wire.
Figure 1C:
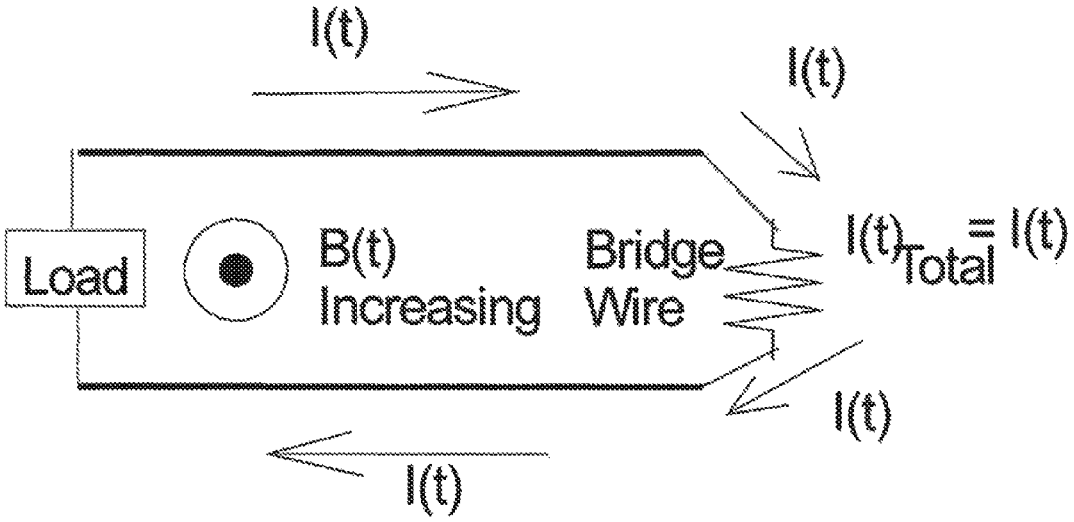
FIG. 1C shows an emf used to drive a differential current mode which results in optimal wire heating.

Ideally, it is of importance to determine the current passing through the bridge wire of a detonator and hence the coupled electromotive force needed to melt the wire. It is theorized that if the bridge wire can be melted, the detonator material will either be activated resulting in an explosion in a controlled environment (typically resulting from a fast heating rate) or rendered harmless resulting in an open circuit (typically a slow heating rate where the bridge wire deflagrates the detonator charge and eventually the bridge wire melts). The pair of leads denoted as detonator wires, detonator leads, detonator transmission line (TL) or just TL connected to the bridge wire has two ends. One end will be defined as the bridge wire end. The bridge wire load is described by its wire impedance given by $Z_w$ (typically the sum of the wire resistance and the wire inductance with contact effects included by way of the measured bridge wire resistance). The second end will be defined as the load, line load, or transmission line load. The load end of the line is defined in terms of a load impedance, $Z_L$. The following two types of loads have been examined: the short circuit load ($Z_L$=0) and the open circuit load (a load inductance in series with the parallel combination of a large load resistance and a small load capacitance.). All intermediate loads that terminate the line should fall within these sets of parameters. Typically, the measured bridge wire resistance ranges from 0.02 to 0.055Ω for ~40 AWG improvised copper wire strands and ranges between 0.58Ω and 2.1Ω for the commercial and military detonator wires tested. The detonator wires are assumed to be in a straight parallel wire configuration. Under this geometrical configuration, coupling an electric field into the line to drive a current to heat the bridge wire is difficult due to a destructive interference effect between the currents coupled in each line yielding a net zero current at the bridge wire. Refer to FIG. 1B. On the other hand, coupling an emf (electromotive force) to the lines to drive a current in a parallel wire line is possible but is dependent on the area encircled by the line with loads. Consequently, an inductive coupling theory with distributed source is developed. Refer to FIG. 1C.

Chart 1, FIG. 1A Flow chart illustrates the approach used to combine theoretical and experimental efforts to study detonator defeat with open and short circuit loads using quais-static fields.

FIG. 1B shows an external field that drives a common current mode which through destructive interference leads to a zero voltage at the wire.

FIG. 1C. shows an emf used to drive a differential current mode which results in optimal wire heating.

Figure 2:
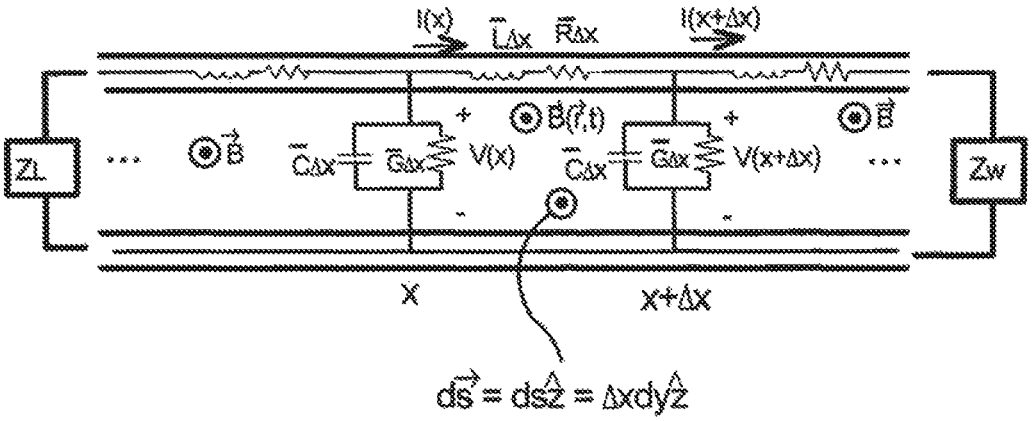
FIG. 2 shows a conventional transmission line model with load terminations and with well-defined coupling areas. This model allows for the development of a distributed flux linkage parameter that couples the external time varying flux to the line with minimal ambiguity in the coupling area.

FIG. 2 shows a conventional transmission line model with load terminations and with well defined coupling areas. This model allows for the development of a distributed flux linkage parameter that couples the external time varying flux to the line with minimal ambiguity in the coupling area.

Inductive Coupling—Distributive EMF Source

It is important to determine the current passing through the bridge wire and hence the emf needed to melt the bridge wire for an open circuit scenario. The emf is determined by evaluating the change in the magnetic field passing normal through the cross-sectional area bounded by the path that the current circulates, in particular, the wires of the circuit.

To minimize the error in choosing the area, a transmission line model as shown in FIG. 2 was employed. The coupling area is well defined among distributed circuit elements between x and x+Δx assuming a balanced line. The error in predicting the area at the end of the line and the lumped circuit components to model the closure of the line is minimized since the element of length is small. It is assumed that the element of length along the transmission line model is small enough that $\vec{B}(x,y,z,t)\approx\vec{B}(x+\Delta x,y,z,t)$. The electromotive force given by Faraday's law can be expressed as a distributive force $\bar{v}_{emf}(x,z,t)$ as given by Eq. (1).

$$\bar{v}_{emf}(x,z,t)=\frac{v_{emf}}{\Delta x}=-\int_0^w\frac{\partial B_z(\bar{r},t)}{\partial t}dy \tag{1}$$

Adding up possible source contributions on the line between 0 and l and taking the inverse transform yields $$l_w(t)=\int_{-\infty}^{\infty}\left[\int_o^t\frac{1}{[Z_w(\omega)\cosh(\gamma_2(\omega)[\ell-\tilde{x}])+Z_{o2}(\omega)\sinh(\gamma_2(\omega)[\ell-\tilde{x}])]}\frac{Z_2(\ell-\tilde{x}^+,\omega)}{[Z_2(\ell-\tilde{x}^+,\omega)+Z_1(\tilde{x}^-,\omega)]}\bar{v}_{emf}(\tilde{x},\omega)d\tilde{x}\right]e^{j\omega t}d\omega \tag{2}$$

Figure 3:
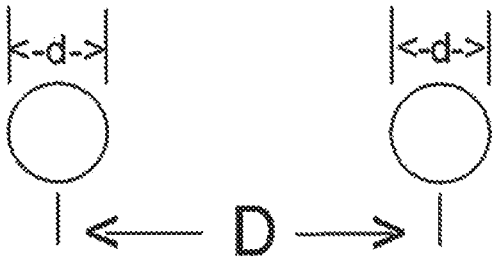
FIG. 3 Cross section view of the parallel wire detonator designating the distance of separation between the centers of both wires and the diameters of the wires.

FIG. 3 Cross section view of the parallel wire detonator designating the distance of separation between the centers of both wires and the diameters of the wires.

Figure 4:
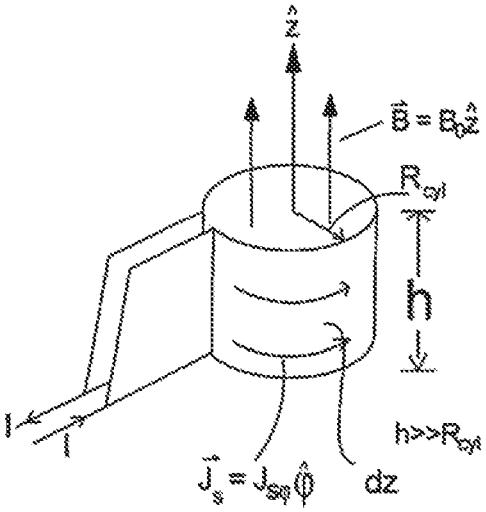
FIG. 4 A proposed solenoid composed of a cylinder that will have a uniform current throughout cross section.
Figure 5:
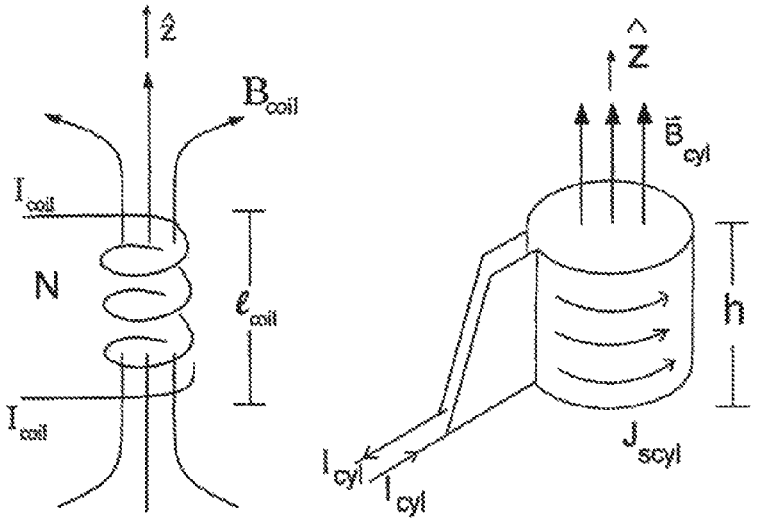
FIG. 5 A comparison between the existing coil solenoid and the proposed cylinder solenoid.

Assume that the magnetic field between the lines is nearly constant with y noting, in FIG. 3, that the width w between the lines is (D-d), the spectral emf for a source at $\tilde{x}$ is $$\bar{v}_{emf}(\tilde{x},\omega)=j\omega\mu_o(D-d)H_z(\omega))=j\omega\mu_o(D-d)J_{s\phi}(\omega) \tag{3}$$

where $J_{s\phi}$ represents the surface current on a cylindrical metallic shell of height h with source current equivalent to the current in an N turn coil solenoid of length l. Refer to FIGS. 4 and 5. Further, assume that the current in the primary side of the electrical circuit is represented by an underdamped signal turned on at t=0

$$i_p(t)=\frac{V_o}{(L+L_o)\tilde{\omega}}e^{-\alpha t}\sin(\tilde{\omega}t)u(t) \tag{4}$$

with corrected resonant frequency given by $\tilde{\omega}=\omega_o[1-(\alpha/\omega_o)^2]^{1/2}$ and attenuation coefficient by $\alpha=0.5\ R_o/(L+L_o)$.

FIG. 4 A proposed solenoid composed of a cylinder that will have a uniform current throughout cross section.

FIG. 5 A comparison between the existing coil solenoid and the proposed cylinder solenoid. By forcing the magnetic field at the central portion of the coil to be equal to the field in the cylinder and by equating the cylinder current $I_{cyl}$ to the coil current $I_{coil}$, the height of the cylinder, h, is related to the coil length, $l_{coil}$, and the number of coil turns, N, as $h=l_{coil}/N$. It is assumed that the surface current over the cylinder is uniform and in the azimuth direction.

Expressing the surface current in terms of the primary current in the frequency domain and the height of the cylindrical shell, the spectral emf for a source at $\tilde{x}$ is $$\bar{v}_{emf}(\tilde{x},\omega)=j\omega\mu_o\frac{(D-d)}{h}\frac{1}{2\pi}\frac{V_o}{(L+L_o)\tilde{\omega}}\frac{\tilde{\omega}}{[(\alpha+j\omega)^2+\tilde{\omega}^2]} \tag{5}$$

Because we have neglected fringe effects in the cylindrical solenoid shell, the magnetic field is uniformly distributed throughout the cross section of the shell. Consequently, the emf is independent of source location.

Figure 6:
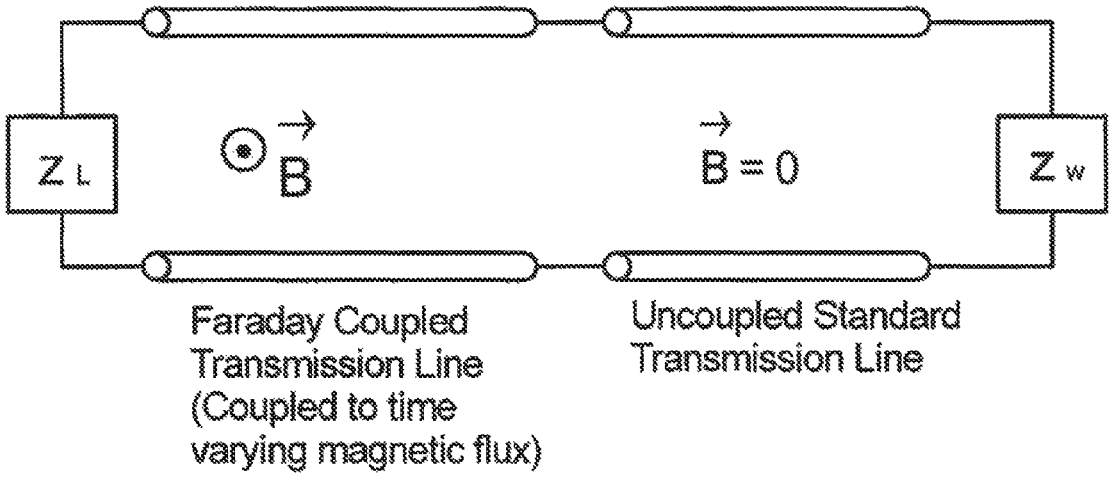
FIG. 6 shows the Faraday coupled line which supports the emf is connected to a second line which is not coupled to the fields.

FIG. 6 In a number of experiments, the Faraday coupled line which supports the emf is connected to a second line which is not coupled to the fields. Depending on the frequency content of the signal coupled to the line, the loading effect of the standard line can affect the current delivered to the wire load. As a result, the coupled theory is extended to add this contribution.

In general due to shielding or orientation, only a fraction of the detonator wire length couples the externally generated magnetic energy to the detonator assembly. If the normal to the bounded area of the detonator circuit is perpendicular to the time varying magnetic field, a zero coupled emf contribution results. In FIG. 6, the standard transmission line is located between the bridge wire and the line responding and coupling to the time varying magnetic field (emf). The loading effects and currents created on the lines added to the network for x>$\tilde{x}$ are given by $$Z_{in,m}=Z_{om}\left[\frac{Z_{in,m+1}\cosh(\gamma_m\ell_m)+Z_{om}\sinh(\gamma_m\ell_m)}{Z_{om}\cosh(\gamma_m\ell_m)+Z_{in,m+1}\sinh(\gamma_m\ell_m)}\right] \tag{6a}$$

$$l_m=(x_m=\ell_m)=l_{m-1}(x_{m-1}=0)\frac{Z_{0m}}{Z_{om}\cosh(\gamma_m\ell_m)+Z_{in,m+1}\sinh(\gamma_m\ell_m)} \tag{6b}$$

where $x_m=0$ and $x_m=l_m$ represent the input and the load sides of the $m^{th}$ line of length $l_m$ in the series of cascaded lines. The characteristic impedance and propagation coefficient of the $n^{th}$ line is given by $Z_{on}(\omega)=\sqrt{(\overline{R}_n+j\omega\overline{L}_n)/(\overline{G}_n+j\omega\overline{C}_n)}$ and $\gamma_n(\omega)=\sqrt{(\overline{R}_n+j\omega\overline{L}_n)(\overline{G}_n+j\omega\overline{C}_n)}$. If there are N lines in the cascade, then $Z_{in,N+1}$ is the impedance of the bridge wire load $Z_w$.

Figure 7:
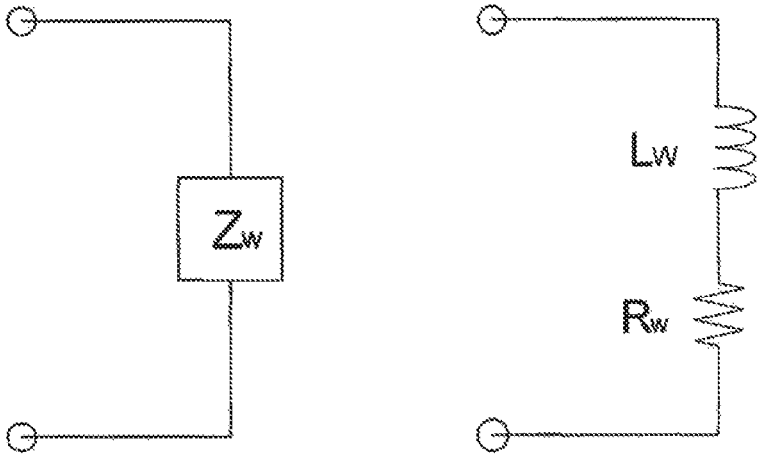
FIG. 7 The bridge wire is modeled as a resistor in series with an inductor. Sometimes the improvised wires are coiled. This allows one to model the inductive effect of the wire under test.

The bridge wire impedance is represented as the series combination of a bridge wire assembly resistance $R_w$ and inductance $L_w$ as shown in FIG. 7. The wire inductance allows for the study of tightly coiled bridge wires where the inductance may not be negligible or for the bridge wire composed of magnetic materials. The detonator load (Refer to FIG. 8) is modeled as a series combination of two inductances in cascade with the parallel combination of a load resistance $R_L$ and load capacitance $C_L$. The two series inductors separate the load inductance $L_L$ from an inductance that may arise from the measuring instrumentation $L_N$ (such as the needle resistor used in experiments).

FIG. 7. The bridge wire is modeled as a resistor in series with an inductor. Sometimes the improvised wires are coiled. This allows one to model the inductive effect of the wire under test.

Figure 8:
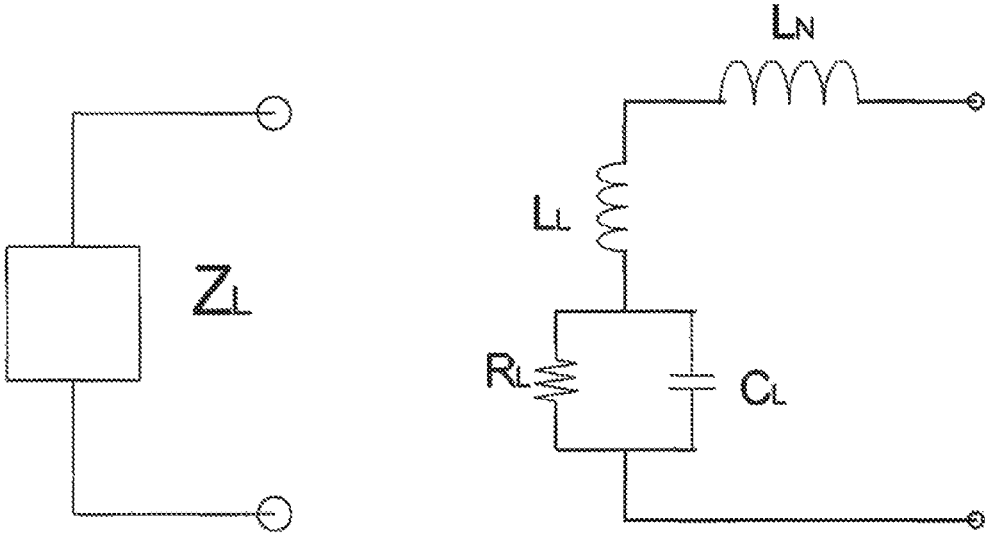
FIG. 8 The detonator load is modeled in terms of a capacitor, resistor, and inductor network. A large load parameter space may be characterized by this model.

FIG. 8 The detonator load is modeled in terms of a capacitor, resistor, and inductor network. A large load parameter space may be characterized by this model.

In the formalism presented, the bridge wire characteristics are considered to be independent of temperature and time. Further, the bridge wire resistance is the resistance measured at the detonator which is the bridge wire resistance proper plus total contact resistance. Therefore, initially, theory and experiment should agree and as time evolves deviations indicate a change in state of the wire directed towards a melt condition. These changes in state are sought.

PSpice Modeling Efforts

Figure 9:
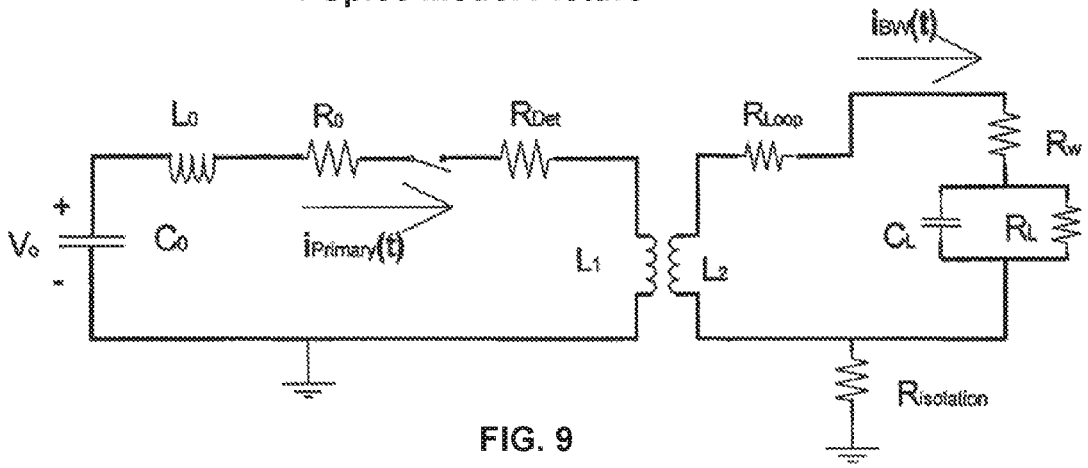
FIG. 9 shows a typical PSpice, lumped element, electric circuit model of the laboratory research setup FIG. 10A, B A) Primary signals and B) secondary signals simulation (green) are compared against theory (blue) and experiment (red).
Figure 10A:
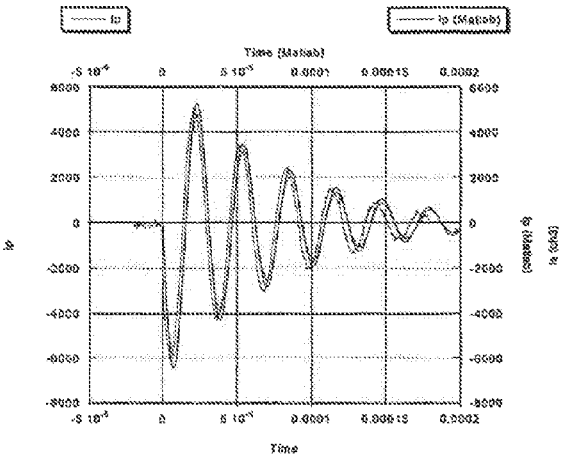
Figure 10B:
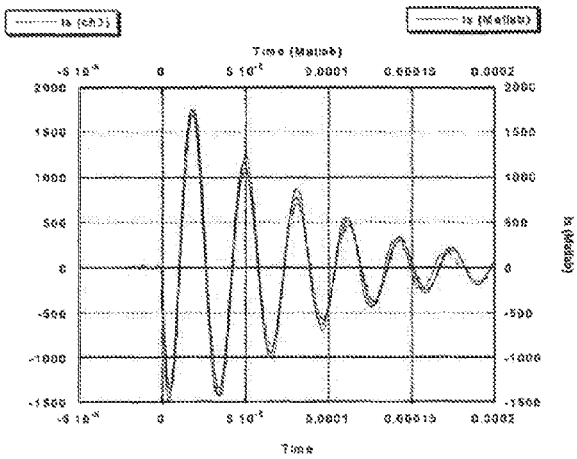

A PSpice modeling tool was used to characterize the coupling between the primary circuit generating the time varying magnetic flux density and the secondary circuit containing the detonator with leads and its connecting load. Refer to FIG. 9. The circuit is composed of lumped elements (resistors, capacitors, inductors, and transformers). Here, only one set of circuit element parameters is described. The measured circuit elements driven by an energized capacitor bank in series with a switch generates a damped 32 kHz signal in the primary circuit. The closing relay that initiates the pulse power to the coil which generates the magnetic field adds some higher frequency content to the changing flux offering greater coupling capability. The wavelength of the dominant damped frequency of oscillation is roughly 9.4 km. Since the wavelength is orders of magnitude larger than the farthest extent of the detonator circuit, a simple lumped model seemed reasonable to employ. A transformer is used as the component to mutually couple the flux from the primary circuit coil of self-inductance $L_1$ to the secondary circuit (detonator circuit) with self inductance $L_2$. The inductance of the secondary circuit is large since a sewing needle is employed in the detonator circuit as the resistor probe. The sewing needle has magnetic properties. Therefore, the needle was modeled as a resistor in series with an inductor in the secondary side of the circuit. Since the needle was also used as a part of the loop to couple the emf into the detonator circuit, its modeled inductance contribution was built into the self inductance of the secondary side of the transformer. A transformer coefficient of coupling factor, k (value between 0 and 1 where 0 represents no coupling and 1 represents maximum coupling [$k=M/\sqrt{L_1L_2}$ where M is the mutual inductance]), in the PSpice model of the transformer allows for one means of tuning the model so that primary and secondary simulation and experiment signal signatures may be forced to agree. Because the detonator circuit is an isolated circuit, the secondary side of the transformer is tied to ground in the simulation through a very large isolation resistance. The simulation model was developed in the following manner. All circuit elements including the connecting wires where experimentally measured using a number of different instruments including an LCR meter. Calibration of the meter was required in order to measure the low parameter values. Because the secondary side of the detector contained only a single loop, it was anticipated that the back emf generated by the secondary and coupled into the primary circuit would be negligible. Therefore, the primary side of the circuit was calibrated in an isolated manner. That is, irrespective of the secondary circuit, the elements in the primary circuit were slightly varied from their experimental value until the frequency of the circuit agreed with experiment. Once good agreement was obtained on the primary side, the primary circuit components were fixed. The secondary components were now varied along with the transformer coefficient of coupling and the charging voltage of the capacitor. Once the amplitudes of the primary and secondary signals were in agreement with experiment, the phase relationship between the primary and secondary signals were compared. If the phase relationship between the simulation signals did not agree with that of the corresponding experimental signals, the coefficient of coupling term was readjusted and the circuit parameters were re-examined. Since the simulation inductance of the needle could not be isolated with simulation resistance of the needle, only simulation current measurements could be computed and compared with experiment. Once the PSpice circuit was calibrated against a reference secondary circuit with 26 AWG copper wire used as the bridge wire, the primary and secondary signal signatures were compare on a theoretical, simulation, and experimental basis at the same time. FIGS. 10A,B illustrate the comparison of the signal signatures. Good agreement is observed indicating that the theoretical and numerical models successfully predict experimental results and can be used as a means for scaling the experiment.

By changing the wire resistance $R_w$ in the model to correspond with that of the measured bridge wire (bridge wire assembly) under test, the signal signature of the short circuit bridge wire current under the condition that the bridge wire does not melt or change its circuit characteristics is examined. This is then compared to the experimental bridge wire currents. That is, the bridge wire leads are shorted with a 1" by 1" loop of wire containing the sewing needle resistor sensor. Initially, measured and simulation currents tend to agree and soon depart from the cold bridge wire resistor simulation. This departure is a sign that the experimental wire is indeed heating and changing state. If the wire does not melt, the bridge wire current is very similar in amplitude and frequency to that in simulation.

FIG. 9 A typical P Spice, lumped element, electric circuit model of the laboratory research setup. The circuit model is well defined for the shorted bridge wire. The transformer acts as the element to characterize the coupling of the time varying magnetic field generated from the primary side (left hand side of the circuit relative to the transformer) to the secondary detonator side (right hand side of the circuit relative to the transformer) of the circuit. The self inductance $L_1$ and $L_2$ represent the inductance of the coil generating the magnetic field and the single loop coil of the detonator capturing the time varying flux.

FIG. 10A, B. A) Primary signals and B) secondary signals simulation (green) are compared against theory (blue) and experiment (red). Over a large time duration, there is reasonably good agreement among all three methods. Although not as important as the secondary signal comparison, the primary experimental signal is slightly shifted to the left in time implying a slightly faster rise time than predicted by the other two techniques. Even so, the secondary signatures are well in phase with each other with a slight difference in amplitude maximums.

Experimental Setup—Detonators with Short Circuit Load

Ten 0.23 μF 60 kV capacitors in a parallel configuration are charged up to either 12 kV or 20 kV. Two metal rods in a parallel configuration act as a detector resistor sensor in the primary circuit. A switch floats the capacitor bank after being charged. Once isolated, a closing relay switch is activated releasing the capacitor bank energy to a low resistance medium inductance network connected to an air core inductor coil. The energy is released in such a way that it rings back and forth at a low frequency ~32 kHz in the primary circuit with an initially fast rise time. The inductor coil transforms the electrical energy into electromagnetic energy. Further, it supports, concentrates, and localizes the electromagnetic energy. The change in the inductor generated magnetic field induces a voltage in the detonator circuit that responds by driving a current dependant on the detonator and load characteristics. The current surge oscillates back and forth in the wire leading to Joule heating and desirable wire melt. Currents, light discharge, optical state of bridge wire, and changes in the magnetic flux are monitored simultaneously.

The geometry of the detonator short circuit loop which includes needle connected to the detonator leads is roughly 1" to 1.25" square. Three real time 6 GHz (20 GS/s) bandwidth Tektronix TDS 6604B and one or two 1 GHz (5 GS/s) bandwidth Tektronix TDS 680B were used to capture the voltage signatures of the primary and secondary electrical resistor sensors, the EM dot sensor, and the optical sensor. Consequently, a standard short circuited detonator with 26 AWG wire wrapped around the posts of a typical detonator without bridge wire was built and carefully characterized with both theory and simulation. This standard short circuit reference monitor has nearly the same geometry as the detonator circuits under test and also uses a sewing needle of same size as a series resistor and inductor to measure the voltage drop and hence the through current.

An ultra high speed, color, digital, Vision Research Inc., Phantom V710 camera with telephoto lens was employed to digitally capture the evolution of the bridge wire melting for a number of different commercial, military, and improvised detonators. The CMOS architecture camera at its lowest resolution (128×8 pixels were 1 pixel is 20 microns) has a 700 ns frame period and a 300 ns shutter speed. Typically, the camera resolution was set for 128×128 pixels frame rate of 215,600 fps or a 4.64 μs frame period with a 300 ns shutter speed. The proximity of the camera from the experiment was typically less than two feet. The depth of field of the telephoto lens was very small roughly on the order of 3 mm with aperture wide open (2.8 fstop). To help increase the resolution, the f-stop of the camera was adjusted to about 8. A larger depth of field was gained at the expense of light intensity.

V. Data Analysis—Short Circuited Detonators

Figure 11A:
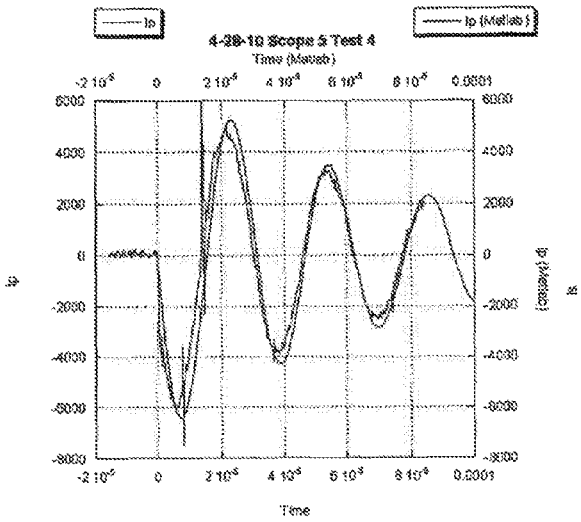
FIG. 11A, B The data from test A4 is compared against theory. The red curve represents the measured A) primary and B) secondary standard current compare to their corresponding theoretical predicated currents (blue curves).

Uniformity and repeatability is established among experiments. Except for two tests out of about forty, the primary currents generated by the capacitor bank and network are very consistent implying a high level of repeatability. The secondary current signals detected by the resistive voltage/current monitoring standard are very smooth. Except for some discrepancies at the peak values, the signal signatures are the same. The presence of the inductance in the needle seems to have filtered out the noise in the primary signal which would normally result in rapid changes in the spiky emf in the secondary circuit. It is concluded that all of the experiments conducted except for one are comparable. FIGS. 11A,B relates the data from one of the comparable tests to the theoretical model based on inductive coupling with distributive EMF source. Good agreement is shown. Table 1 provides a brief summary of calculated and experimental data regarding wire melt studies for over thirty short circuited detonator experiments.

Figure 12A:
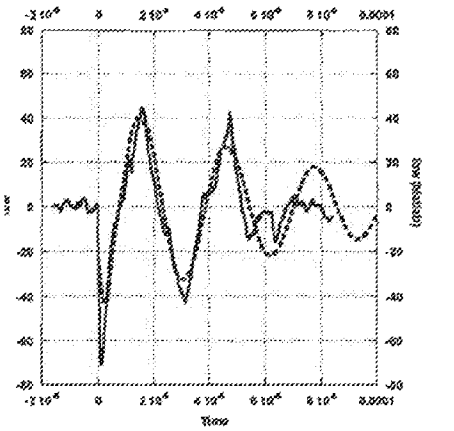
FIG. 12A-F Short circuit wire melt tests with (A,B) Nichrome (Test A5); (C,D) Cu Improvised (Test B2); (E,F) Tungsten (Test B16) bridge wires.
Figure 12B:
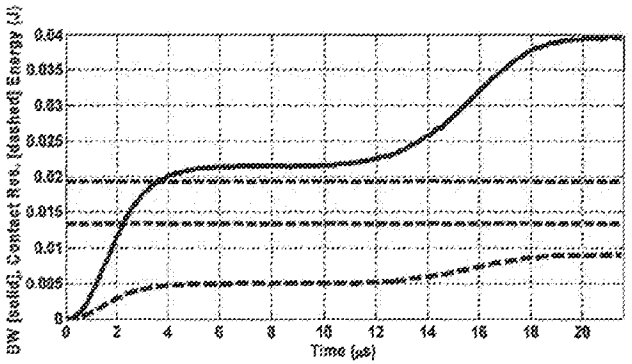
Figure 12C:
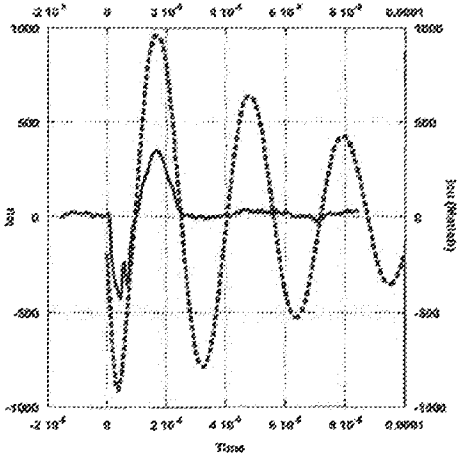
Figure 12D:
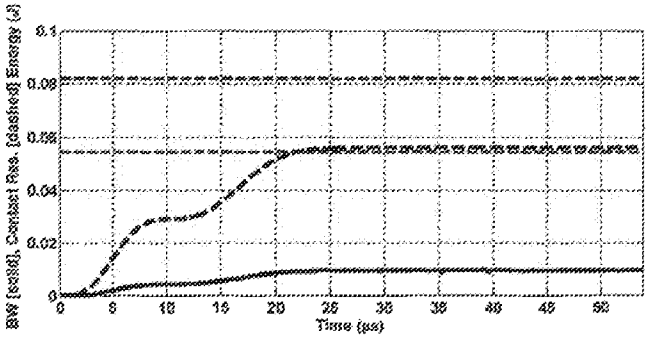
Figure 12F:
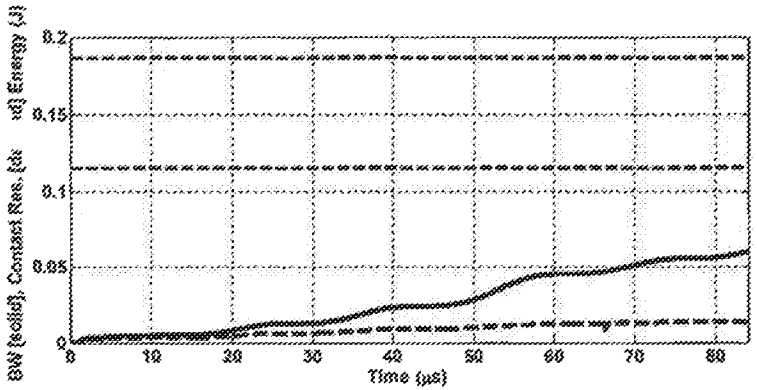
Figure 12E:
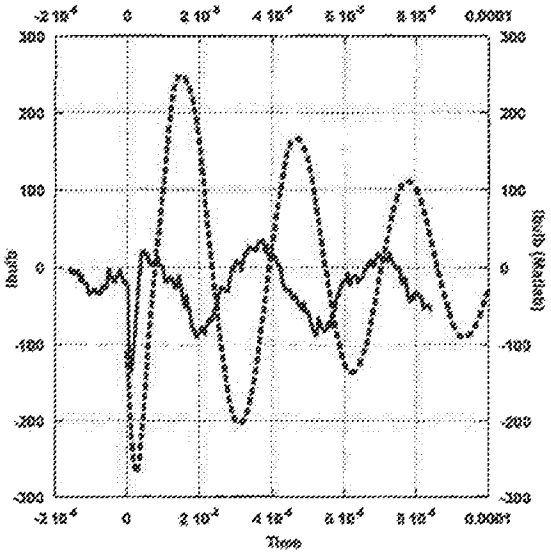

Three representative studies will be briefly presented in FIGS. 12A-F. The dashed damped sinusoidal line in FIGS. 12A, 12C, and 12E is the theoretical prediction of the bridge wire current if the wire retains its cold resistance value. The solid line is the experimentally measured bridge wire current. In FIGS. 12B, 12D, and 12F, the two dashed horizontal lines demarcate the energies needed to initiate bridge wire melt (lower dashed line) and to complete the melting process of the entire wire (upper dashed line). The remaining solid and dashed curves in these plots are the calculated energies over time dissipated in the bridge wire and contact resistance effects of the detonator associated with the bridge wire. In the nichrome study (FIGS. 12A,B), the bridge wire current exceeded the peak currents predicted. Further, the initial rise in current is much faster. At about 50 μs plus a significant deviation from predication exists. FIG. 12B suggests that the bridge wire itself completely melted at the 40 μs point in time. This suggests that although the wire melted or vaporized into an ionized gas, the gas is stable for a short period acting as a conduit to conduct electricity. In this case, the wire melted prior to the contact resistance effects reaching the point for melt. The improvised copper (FIGS. 12C,D) illustrates a different scenario. Within the first 20 μs although the oscillation pattern is similar, the current amplitudes are over a factor of two smaller than predicted. After 20 μs, no current is measured. This implies that an open circuit condition was generated at or in the bridge wire. From energy plots, the contact resistance effects reach temperatures to initiate melt. Although not displayed here, video visuals indicate that at the contact points, plasma discharge is generated causing melt. Melt is a consequence of non-uniformities in the wire as the wire is wrapped around the detonator posts. FIGS. 12E,F illustrate a tungsten wire study. In this case the measured tungsten wire current does not agree with predicted simulation bridge wire currents as suggested in FIG. 12E. This is a consequence that the tungsten wire is formed in the shape of a number of very small coils. The out of phase peak shifts is a sign of an inductance phase shift. Further, the inductance in this wire geometry tends to slow down the change in current. Consequently, maximum currents are not attained. It is further observed in FIG. 12F that the tungsten wire does not reach the point of melting. Even though tungsten wires are hard to melt, chromaticity studies tend to show that the wire reaches high enough temperatures to initiate burn in most materials.

TABLE 1

The calculated bridge wire energy initializing the melt and for complete melt based on the measured bridge wire diameter. The melt times for the bridge wire and the contact resistance are provided. This table is based on experiments conducted on three different occasions denoted as A, B, and C.

| Test # | Bridge Wire Material | $R_{BW}$ (measured) (Ω) | $R_{BW}$ (calculated) (Ω) | $R_{BW}$ (contact) (Ω) | Meas. Dia. (mm) | Length (mm) | Energy initiate melt (J) | Energy total melt (J) | Time(μs): melt initiated BW | Time(μs): melt initiated Cont. Res. | Time(μs): total melt BW | Time(μs): total melt Cont. Res. |
|---|---|---|---|---|---|---|---|---|---|---|---|---|
| A1 | Cu | 0.0357 | 0.00402 | 0.0317 | 0.1 | 1.88 | 0.0542 | 0.0819 | N/A | N/A | N/A | N/A |
| A2 | Platinum | 0.590 | 0.199 | 0.391 | 0.035 | 1.805 | 0.0085 | 0.0127 | | | | |
| A3 | Platinum | 0.579 | 0.199 | 0.380 | 0.035 | 1.805 | 0.0085 | 0.0127 | 2.4 | 12.7 | 3.5 | N/A |
| A4 | Nichrome | 1.980 | 1.627 | 0.353 | 0.04 | 2.045 | 0.0134 | 0.0193 | 2.4 | N/A | 3.3 | N/A |
| A5 | Nichrome | 2.07 | 1.63 | 0.443 | 0.04 | 2.045 | 0.0134 | 0.0193 | 2.3 | N/A | 3.7 | N/A |
| A6 | Nichrome | 0.869 | 0.869 | 0 | 0.0289 | 0.57 | 0.0015 | 0.0022 | 56.9 | N/A | N/A | N/A |
| A7 | Nichrome | 0.806 | 0.806 | 0 | 0.0254 | 0.57 | 0.0015 | 0.0022 | N/A | N/A | N/A | N/A |
| A8 | Nichrome | 0.819 | 0.819 | 0 | 0.0298 | 0.57 | 0.0015 | 0.0022 | 1 | N/A | 1.1 | N/A |
| A9 | Tungsten | 0.580 | 0.4099 | 0.170 | 0.054 | 16.187 | 0.3280 | 0.5321 | 30.2 | N/A | 35.1 | N/A |
| A10 | Tungsten | 0.452 | 0.3412 | 0.1108 | 0.036 | 5.988 | 0.0539 | 0.0875 | N/A | N/A | N/A | N/A |
| A11 | Platinum | 1.155 | 0.213 | 0.942 | 0.0363 | 2.077 | 0.0054 | 0.0081 | 15.8 | 11.9 | 17.8 | 16.7 |
| A12 | Platinum | 1.234 | 0.213 | 1.021 | 0.0363 | 2.077 | 0.0054 | 0.0081 | 18.4 | 5.9 | N/A | 18.6 |
| A13 | Nichrome | 1.892 | 1.389 | 0.503 | 0.0405 | 1.79 | 0.0120 | 0.0174 | 13.9 | N/A | 15.5 | N/A |
| A14 | Nichrome | 1.869 | 1.389 | 0.480 | 0.0405 | 1.79 | 0.0120 | 0.0174 | 13 | 22 | 14.6 | N/A |
| A15 | Cu | 1.980 | 0.03067 | 1.949 | 0.036 | 1.86 | 0.0070 | 0.0106 | 49 | 1.2 | 67.9 | 1.4 |
| A16 | Cu | 2.073 | 0.0117 | 2.061 | 0.0628 | 2.154 | 0.0081 | 0.0122 | 3.6 | 0.8 | 3.9 | 0.9 |
| A20 | Cu | 0.0357 | 0.004021 | 0.03168 | 0.1 | 1.88 | 0.0542 | 0.0819 | N/A | 16.4 | N/A | N/A |
| B1 | Cu | 0.0357 | 0.004021 | 0.03168 | 0.1 | 1.88 | 0.054 | 0.082 | N/A | 16.3 | N/A | N/A |
| B2 | Cu | 0.0357 | 0.004021 | 0.03168 | 0.1 | 1.88 | 0.054 | 0.082 | N/A | 21.5 | N/A | N/A |
| B3 | Tungsten | 3.215 | 0.1237 | 3.09 | 0.036 | 2.171 | 0.020 | 0.032 | N/A | 2.6 | N/A | 3 |
| B4 | Tungsten | 3.215 | 0.1237 | 3.09 | 0.036 | 2.171 | 0.020 | 0.032 | N/A | 23.4 | N/A | 58.3 |
| B5 | Tungsten | 0.259 | 0.1335 | 0.1255 | 0.046 | 1.656 | 0.024 | 0.040 | 14.6 | N/A | N/A | N/A |
| B6 | Tungsten | 0.552 | 0.0578 | 0.494 | 0.046 | 1.656 | 0.024 | 0.040 | N/A | N/A | N/A | N/A |
| B7 | Platinum | 1.186 | 0.505 | 0.6855 | 0.0254 | 2.39 | 0.004 | 0.007 | 3.8 | 4.4 | 3.9 | 5 |
| B8 | Tungsten | 0.975 | 0.44897 | 0.526 | 0.038 | 8.779 | 0.062 | 0.101 | 2.6 | 16.9 | 2.9 | 32.3 |
| B9 | Tungsten | 0.975 | 0.44897 | 0.526 | 0.038 | 8.779 | 0.062 | 0.101 | 2.5 | 19.6 | 2.8 | N/A |
| B10 | Platinum | 1.316 | 0.427 | 0.889 | 0.0254 | 2.041 | 0.004 | 0.006 | 1.2 | 1.6 | 1.3 | 2.3 |
| B11 | Tungsten | 0.620 | 0.3358 | 0.284 | 0.054 | 13.26 | 0.269 | 0.436 | N/A | N/A | N/A | N/A |
| B12 | Tungsten | 0.620 | 0.3447 | 0.275 | 0.0533 | 13.26 | 0.269 | 0.436 | N/A | N/A | N/A | N/A |
| B16 | Tungsten | 0.308 | 0.1673 | 0.1407 | 0.052 | 6.125 | 0.115 | 0.187 | N/A | N/A | N/A | N/A |
| B17 | Tungsten | 0.308 | 0.0689 | 0.239 | 0.0810 | 6.125 | 0.115 | 0.187 | N/A | N/A | N/A | N/A |
| C1 | Tungsten | 0.593 | 0.3458 | 0.257 | 0.054 | 13.26 | 0.261 | 0.424 | 6.1 | N/A | 10.8 | N/A |

[Note:
E(energy total melt) = $c_p m(T_{melt} - T_{room}) + m\Delta H_{fusion}$ ; E(energy initiate melt) = $c_p m(T_{melt} - T_{room})$; $T_{room}$ = 293.15 K]

Figure 11B:
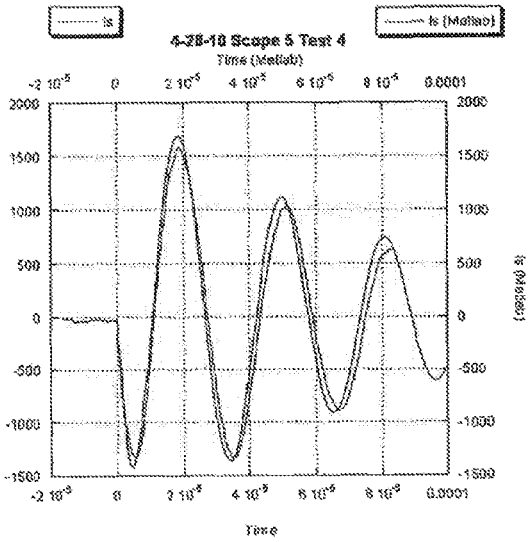

FIGS. 11A 11B The data from test A4 is compared against theory. The red curve represents the measured A) primary and B) secondary standard current compare to their corresponding theoretical predicated currents (blue curves). It is noted that the secondary currents are slightly shifted in phase relative to each other that becomes more apparent at the larger times. Typically after one period, wire melt or intense flash has resulted. Note that both the magnitudes and phases agree. Further, not shown, the relative phasing between the primary and secondary measurements and the primary and secondary theoretical prediction also agree.

FIG. 12A-F Short circuit wire melt tests with (A,B) Nichrome (Test A5); (C,D) Cu Improvised (Test B2); (E,F) Tungsten (Test B16) bridge wires. Figures A,C, and E provide experimental data (solid line) superimposed on theoretical predictions (dashed line). Theoretical predictions assume a room temperature bridge wire resistance. Figures B,D, and F provide instantaneous energy curves dissipated in the bridge wire (solid line) and contact resistance (dashed line). The two horizontal dashed lines represents the energy threshold to initiate melt (lower dashed line) and the energy required for complete bridge wire melt (upper dashed line). These thresholds are based solely on the energy required to melt the bridge wire proper. It is noted that the contact resistance also takes into consideration all inhomogeneities contained in the bridge wire.

TABLE 2

A representative study of the frequency and magnetic flux needed to melt or activate bridge wires. Estimates are based on theoretical bridge wire amplitude with room temperature resistance and on both the theoretical and experimental data regarding the first half period [$T_{1/2}$]and the time duration between peak two and four [$T_{24}$]. The room temperature, $T_o$, measured bridge wire resistance $R_{BWm}(T_o)$ is used to determine the electromotive force with frequency appropriately associated with the first half period or the following full period.

| Material | Test | $T_{1/2}$ (s) | $T_{24}$ (s) | $\lvert I_{max}\rvert$ (A) | $R_{bwm}$ (Ω) | $f_{1/2}$ (Hz) | $f_{24}$ (Hz) | $\omega_{1/2}$ (rad/s) |
|---|---|---|---|---|---|---|---|---|
| Nichrome | A4 | 7.40E−06 | 3.10E−05 | 43.91 | 1.98 | 67568 | 32258 | 4.25E+05 |
| Nichrome | A5 | 7.10E−06 | 3.14E−05 | 42.73 | 2.07 | 70423 | 31847 | 4.42E+05 |
| Nichrome | A13 | 7.30E−06 | 3.10E−05 | 47.36 | 1.892 | 68493 | 32258 | 4.30E+05 |
| Nichrome | A14 | 7.30E−06 | 3.15E−05 | 47.86 | 1.896 | 68493 | 31746 | 4.30E+05 |

TABLE 2-continued

A representative study of the frequency and magnetic flux needed to melt or activate bridge wires. Estimates are based on theoretical bridge wire amplitude with room temperature resistance and on both the theoretical and experimental data regarding the first half period [$T_{1/2}$]and the time duration between peak two and four [$T_{24}$]. The room temperature, $T_o$, measured bridge wire resistance $R_{BWm}(T_o)$ is used to determine the electromotive force with frequency appropriately associated with the first half period or the following full period.

| | | | | | | | | |
|---|---|---|---|---|---|---|---|---|
| Nichrome | A6 | 7.60E−06 | 3.16E−05 | 100 | 0.869 | 65789 | 31616 | 4.13E+05 |
| Nichrome | A8 | 7.30E−06 | 3.12E−05 | 106.1 | 0.819 | 68493 | 32051 | 4.30E+05 |
| Platinum | A3 | 7.50E−06 | 3.17E−05 | 146.15 | 0.579 | 66667 | 31546 | 4.19E+05 |
| Platinum | A11 | 7.30E−06 | 3.12E−05 | 77.14 | 1.155 | 68493 | 32051 | 4.30E+05 |
| Platinum | A12 | 7.20E−06 | 3.15E−05 | 70.32 | 1.234 | 69444 | 31746 | 4.36E+05 |
| Platinum | B10 | 7.40E−06 | 3.14E−05 | 66.88 | 1.316 | 67568 | 31847 | 4.25E+05 |
| Copper | A15 | 7.40E−06 | 3.12E−05 | 47.02 | 1.98 | 67568 | 32051 | 4.25E+05 |
| Copper | A1 | 7.20E−06 | 3.10E−05 | 926.96 | 0.0357 | 54348 | 32258 | 3.41E+05 |
| Copper | A20 | 7.70E−06 | 3.10E−05 | 961.23 | 0.0357 | 51546 | 32258 | 3.24E+05 |
| Copper | B1 | 7.40E−06 | 3.12E−05 | 959.08 | 0.0357 | 53191 | 32051 | 3.34E+05 |
| Copper | B2 | 7.40E−06 | 3.10E−05 | 959.74 | 0.0357 | 53191 | 32258 | 3.34E+05 |
| Tungsten | A9 | 7.60E−06 | 3.17E−05 | 146.15 | 0.58 | 65789 | 31546 | 4.13E+05 |
| Tungsten | B8 | 7.30E−06 | 3.12E−05 | 89.84 | 0.975 | 68493 | 32051 | 4.30E+05 |
| Tungsten | B9 | 7.50E−06 | 3.11E−05 | 89.55 | 0.975 | 66667 | 32154 | 4.19E+05 |
| Tungsten | B16 | 7.90E−06 | 3.10E−05 | 266.22 | 0.308 | 63291 | 32258 | 3.98E+05 |
| Tungsten | C1 | 7.60E−06 | 3.13E−05 | 240.24 | 0.593 | 65789 | 31949 | 4.13E+05 |

| Material | $\omega_{24}$ (rad/s) | $\lvert V_{emf}\rvert_{1/2}$ (V) | $\lvert V_{emf}\rvert_{24}$ (V) | $\Phi_{m1/2}$ (Wb) | $\Phi_{m24}$ (Wb) | $B_{1/2}$ (Wb/m$^2$) | $B_{24}$ (Wb/m$^3$) |
|---|---|---|---|---|---|---|---|
| Nichrome | 2.03E+05 | 87.552 | 87.521 | 0.00020623 | 0.00043181 | 0.31973 | 0.66948 |
| Nichrome | 2.00E+05 | 89.046 | 89.015 | 0.00020124 | 0.00044485 | 0.31201 | 0.68969 |
| Nichrome | 2.03E+05 | 90.266 | 90.231 | 0.00020975 | 0.00044518 | 0.32519 | 0.6902 |
| Nichrome | 1.99E+05 | 91.41 | 91.375 | 0.00021241 | 0.0004581 | 0.32931 | 0.71023 |
| Nichrome | 1.99E+05 | 88.39 | 88.244 | 0.00021383 | 0.0004438 | 0.33152 | 0.68807 |
| Nichrome | 2.01E+05 | 88.506 | 88.326 | 0.00020566 | 0.00043859 | 0.31885 | 0.67999 |
| Platinum | 1.98E+05 | 86.944 | 86.616 | 0.00020756 | 0.000437 | 0.3218 | 0.67751 |
| Platinum | 2.01E+05 | 90.219 | 90.126 | 0.00020964 | 0.00044753 | 0.32502 | 0.69385 |
| Platinum | 1.99E+05 | 87.794 | 87.711 | 0.00020121 | 0.00043973 | 0.31195 | 0.68175 |
| Platinum | 2.00E+05 | 88.972 | 88.903 | 0.00020957 | 0.00044429 | 0.32492 | 0.68882 |
| Copper | 2.01E+05 | 93.753 | 93.72 | 0.00022083 | 0.00046538 | 0.34238 | 0.72152 |
| Copper | 2.03E+05 | 63.259 | 52.247 | 0.00018525 | 0.00025778 | 0.28721 | 0.39965 |
| Copper | 2.03E+05 | 63.961 | 54.178 | 0.00019749 | 0.00026731 | 0.30618 | 0.41443 |
| Copper | 2.01E+05 | 64.771 | 53.97 | 0.0001938 | 0.00026799 | 0.30047 | 0.41549 |
| Copper | 2.03E+05 | 64.816 | 54.095 | 0.00019394 | 0.00026689 | 0.30068 | 0.41379 |
| Tungsten | 1.98E+05 | 87.079 | 86.762 | 0.00021066 | 0.00043773 | 0.3266 | 0.67865 |
| Tungsten | 2.01E+05 | 88.927 | 88.798 | 0.00020664 | 0.00044094 | 0.32037 | 0.68363 |
| Tungsten | 2.02E+05 | 88.631 | 88.512 | 0.00021159 | 0.00043811 | 0.32805 | 0.67924 |
| Tungsten | 2.03E+05 | 86.732 | 85.79 | 0.0002181 | 0.00042327 | 0.33814 | 0.65623 |
| Tungsten | 2.01E+05 | 146.25 | 145.74 | 0.0003538 | 0.00072602 | 0.54852 | 1.1256 |

(*Only first half of cycle is matched properly.)

Overall Comments (Short Circuited Bridge Wire)

For the range of discharges examined using a 12 kV capacitor charging voltage, detonator peak melt currents are around 500 A for low resistant elements (~0.02 to 0.055Ω) and about 150 A for high resistive elements (~2Ω). Based on a DC calculation, the amount of power needed to melt the low resistance wire is 13.75 kW and the amount to melt the high resistance wire is 45 kW. For a melt time on the order of 2 μs to 40 μs, the maximum amount of energy required to melt the low resistance wires is about 0.55 J and about 1.8 J for the high resistance wires. These are extremely conservative maximum values.

The energy needed in order to activate the bridge wires in a melt condition is based on the energy stored in a capacitor bank; 0.5 $CV^2$. The capacitance of the capacitor bank is 2.3 μF. Therefore, for a charging voltage of 12 kV, the energy stored in the capacitor bank is about 166 J. For a charging voltage of 20 kV, the bank energy is about 460 J. Less than 0.5% of this energy is needed to melt one bridge wire.

Table 2 provides a number of calculated and measured results. Conservatively, it is estimated that the peak DC magnetic flux densities of 0.35 Wb/m$^2$ and 0.75 Wb/m$^2$ in time durations of 10 μs and 32.5 μs respectively passing normal through a 1" by 1" detonator load area is usually sufficient to melt all military and commercial wires and cause some of the improvised tungsten wires to flash or at least heat up. With a natural 25% damped ring per period and a period of 32.5 μs most improvised tungsten wires would visibly glow. Based on gross comparisons with chromaticity curves, the tungsten wire temperatures range between 753° K to 8,000° K. Increasing the magnetic flux density by about 65% tends to drive the tungsten wire hot for the time durations specified. Short circuit melt conditions are summarized in Table 3.

TABLE 3

Summarized short circuit melt conditions and bridge wire resistance.

| Bridge Wire Material | Bridge Wire Resistance, $R_{BW}$ [Ω] | Threshold Voltage for Wire Melt, $V_{SCThreshold}$ = $\lvert V_{emf}\rvert_{1/2}$ [V] | Est. Consecutive Time Duration for Wire Melt, $\Delta t_{RefMelt}$ [μs] |
|---|---|---|---|
| Nichrome (high) | 1.98 | 87.6 | 30 |
| Nichrome (low) | 0.869 | 88.4 | 30 |
| Platinum | 1.155 | 90.2 | 30 |
| Copper | 0.0357 | 64.0 | 30 |
| Tungsten | 0.593 | 146.3 | 30 |

Figure 13A:
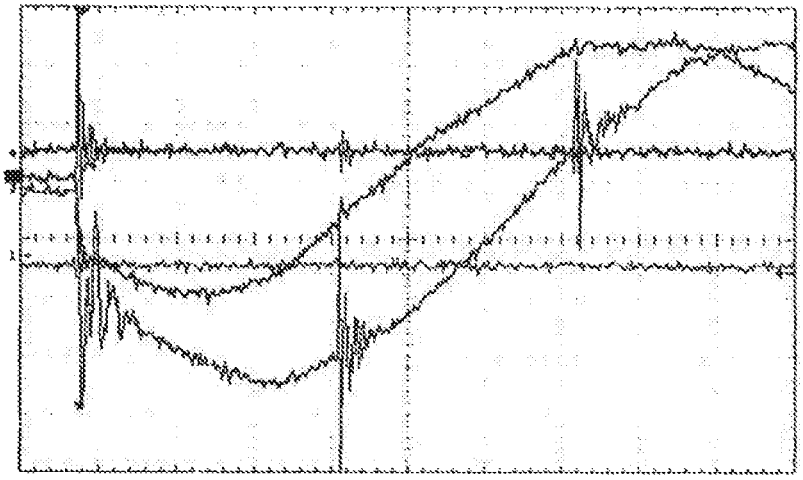
FIG. 13A, B A ground test study illustrating that the noise signal has been successfully removed from the line.
Figure 13B:
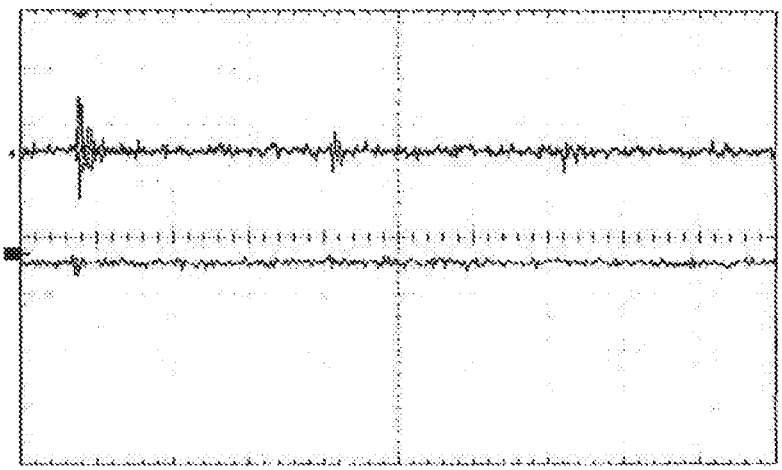

FIG. 13 A,B A ground test study illustrating that the noise signal has been successfully removed from the line. In (A) the sinusoidal curve with chirp superimposed on the signal at three distinct ranges in time is the primary signal (solid blue line channel 2). A coaxial cable with open end is placed in properly grounded solid copper conduit with open end. The nearly straight line signal shows that the line itself does not pick up a signal (golden rod channel 1). A set of twisted pair leads encapsulated in aluminum foil tends to attenuate but still detect some of the high frequency chirp generated by the primary (green channel 4). A direct comparison between the twisted pair aluminum foil shield line and the line in solid copper tubing is shown in (B). The coaxial cable in solid copper conduit is not susceptible to noise pick-up. Therefore, all bridge wire-free experiments the coaxial cable connected to the detonator posts in place of the bridge wire will be embedded in properly grounded copper tubes and shielded at all ends and junctions with aluminum foil.

VI. Extending Experimental Studies to the Bridge Wire-Free Detonator with an Open Circuit Detonator Load Consider the oscilloscope signals in FIGS. 13A,B. The blue curve (channel 2) represents the primary signal due to the capacitor bank with switch. The under-damped sinusoid is characteristic of the capacitor bank connected to the electrical components in the circuit. The sparse occurrences of high frequency noise riding on the under-damped signal are due to the contact properties of the relay. A large electrical discharge occurs at the closing of the switch due to air breakdown. It is anticipated that the switch may briefly break contact while settling in its new closed state resulting in air breakdown at later points in time at a much smaller extent. The electrical discharge (plasma/arc formation) at the switch frequency up-converts the low-frequency damped sinusoidal signal resulting in a relatively strong high frequency noise signal. Noise coupling of the electromagnetic pulse into the recording instrumentation has been removed by shielding coaxial lines with properly grounded solid copper tubes and aluminum foil at the tube junctions.

To determine the bridge wire current, we measured the emf felt at the bridge wire terminals when connected directly to a 50Ω oscilloscope load by way of a 50Ω coaxial cable. Cable losses are neglected in all calculations and measurements. The electromotive force induced or coupled in the circuit, sometimes called voltage, is a property of the rate of change in the resultant magnetic field passing normal through some area encircled by the detonator circuit. If we can neglect back emf effects resulting from the current generated in the detonator circuit, then one may argue that the resultant emf is not affected by the nature of the detonator circuit. Consequently, the measured emf using a 50Ω scope is the same emf that a particular bridge wire would experience. From Ohm's law the current passing through the hypothetical bridge wire under test can then be determined.

Figure 14A:
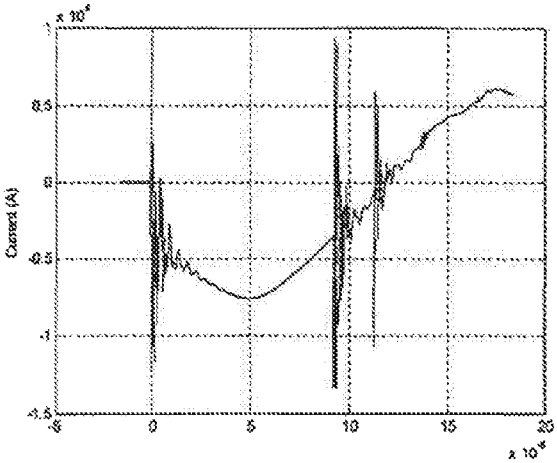
FIG. 14A-C Typical primary current and detonator emf (at the bridge wire) temporal and spectral (power spectral density) signals.
Figure 14B:
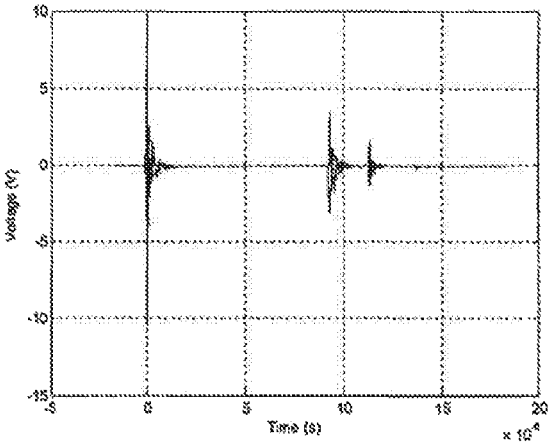
Figure 14C:
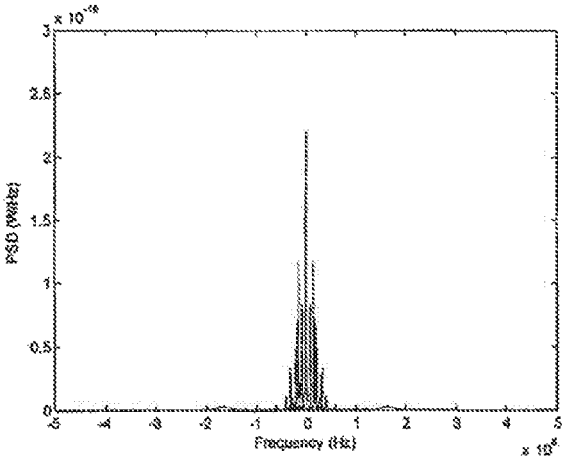

Typical temporal and spectral signals of the primary and secondary are presented in FIGS. 14A-C. The load end of the bridge wire-free detonator is an open circuit. It is easily observed that the low frequency component of the primary circuit signal does not drive a measurable voltage at the bridge wire terminals. Although the signal is coupled to the detonator, the response time of the detonator circuit assembly is faster than the recording time of the oscilloscope suggesting that the coupled emf appears to experience the nature of the detonator load, the open circuit, instantaneously. That is, space charge effects at the open end of the bridge wire load builds up so fast that it counters the low frequency emf. Hence, no measurable current is driven in the circuit and no voltage is measured at the bridge wire since voltage requires current flow. This further implies that the low frequency component of the signal does not heat the bridge wire in the detonator with open circuit load. On the other hand, there is a strong correlation between the chirp signals in the primary and detonator circuits. The chirp signals in the primary stimulus are due to the air discharge generated at the relay switch upon closing.

FIG. 14A-C Typical primary current and detonator emf (at the bridge wire) temporal and spectral (power spectral density) signals. The load side of the detonator is 1" long parallel wire separated by 2 mm with detonator casing external to the copper tube ground. The primary signature (A) is composed of the typical RCL underdamped signal with a superimposed chirp signal. The chirp signal is due to discharge generation at a closing relay that somewhat bounces. The open circuit detonator appears to respond to only the chirp portion of the primary signal as shown in (B). The power spectral density is shown in (C).

TABLE 4

Correction factor study.

| Configuration No. # | $CF \times 10^{11}$ |
|---|---|
| Average | 3.79 |
| Minimum | 1.25 |
| Maximum | 8.00 |
| Standard Deviation | 1.74 |

VII. Alternative Partial Information Coupling Theory for Detonator with Open Circuit Load—Scaling Voltage Amplitude and Time Duration Laws An alternative coupling model based on empirical data and theory was developed to determine the conditions needed at an external primary coil for bridge wire melt in the detonator with open circuit load. Complete knowledge of the coupling mechanism between the primary and secondary circuits as well as complete knowledge of the secondary (detonator) circuit is not required to predict required conditions for wire melt in the detonator. It was observed that the amplitude of the electromotive force may vary by as much as a factor of four or five for the numerous open circuit load configurations. This implies that the electromotive force coupled into the secondary (the bridge wire terminals of the detonator with open circuit load) is not too sensitive to the open circuit configuration within the types examined. Consequently, an overall reference correction factor ($CF_{RefOC}$) is established based on the amplitude ratio of the measured primary and normalized secondary currents. This correction factor physically takes into account all of the unknowns in the coupling process. We have chosen conservative short circuit melt conditions for copper, platinum, nichrome, and tungsten as indicated by the shaded rows in Table 2.

Figure 15A:
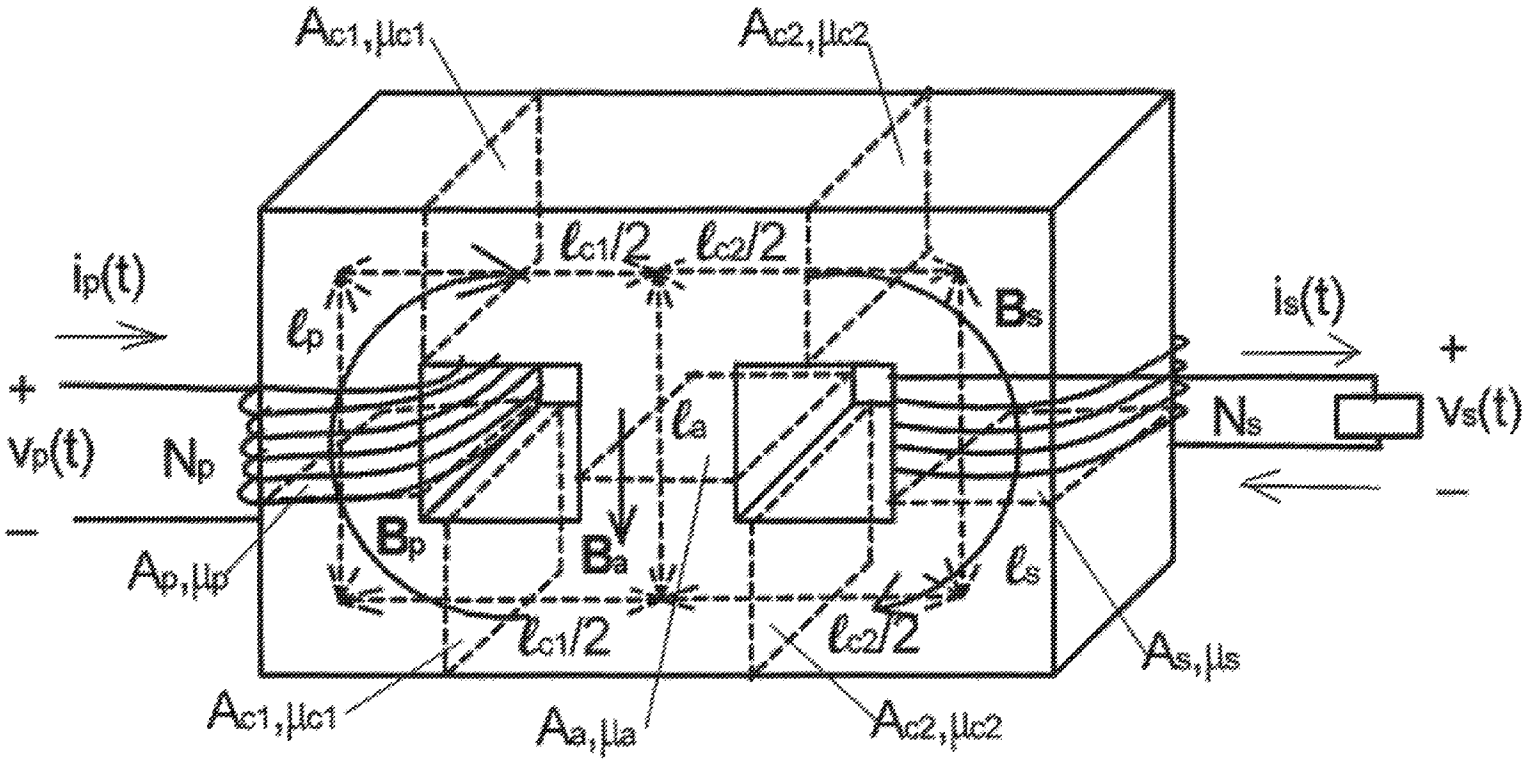
FIG. 15A, B (A) Magnetic circuit of the primary coil and secondary (detonator) coil with (B) superimposed electrical circuit model.
Figure 15B:
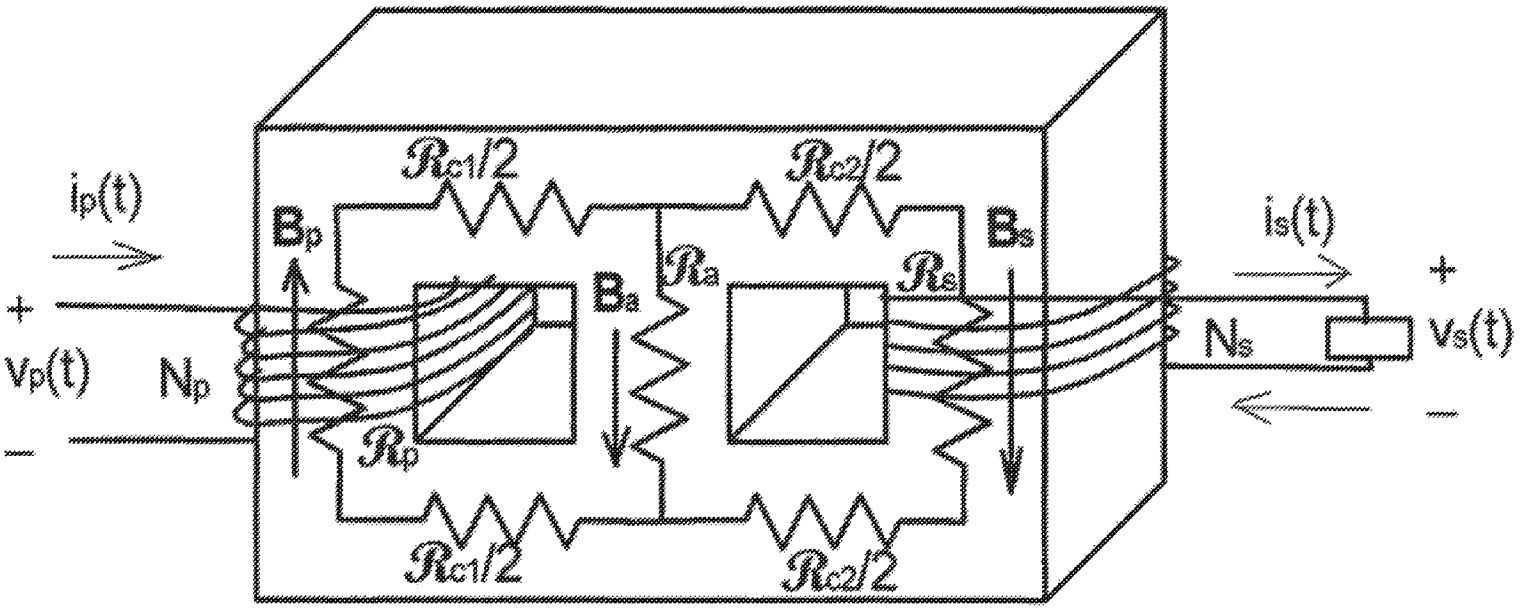

FIGS. 15A, 15B (A) Magnetic circuit of the primary coil and secondary (detonator) coil with (B) superimposed electrical circuit model.

Theory and Model to Backup Discussions—Amplitude Scaling Law

To illuminate and quantify the physics further, we represented the detonator, primary coil, and interaction region assembly in a very general magnetic circuit model where an alternative parallel path exists that diverts a fraction of the flux generated at the primary away from the secondary. For simplicity, the core is assumed to contain all of the magnetic flux, to uniformly distribute the magnetic flux over core cross section, and to respond fast enough to the source voltage in a linear fashion. Based on the voltage, current, and flux orientations in FIGS. 15 A,B, the coupling equations relating the rate of change of currents to the electromotive force or, equivalently, the primary and secondary (detonator) coil voltages are $$v_p(t) = -L_p \frac{\partial i_p(t)}{\partial t} + M_{ps} \frac{\partial i_s(t)}{\partial t} \tag{7a}$$

$$v_s(t) = -L_s \frac{\partial i_s(t)}{\partial t} + M_{sp} \frac{\partial i_p(t)}{\partial t} \tag{7b}$$

where L and M are the self inductance and mutual inductance respectively. Subscripts 'p', 's', and 'a' in FIGS. 15A,B and Eqs. (7a,b) represent the characteristics of the primary, secondary, and alternative flux paths. If a linear magnetic medium is isotropic in nature, one can expect that the mutual inductance $M_{sp}$ and $M_{ps}$ are equivalent. This model allows one to establish a comparative set of approximations, determine the properties of the coupling factor without complete information, and develop a scaling law.

For the detonator configurations under investigation, two apparent approximations may be made. First, the back emf on the secondary due to the self inductance effects of the secondary is assumed small compared to the primary coupled emf because the detonator (secondary) is a single turn at best and its load is an open circuit. Therefore, $$M_{sp} \frac{\partial i_p(t)}{\partial t} \gg L_s \frac{\partial i_s(t)}{\partial t} \tag{8}$$

Typically, it is desired that most of the magnetomotive force (mmf) be transferred to the secondary (detonator) and any associated alternative flux path. Because the detonator load is an open circuit, the current flow in the secondary is impeded by space charge effects (capacitive effects) at the open end. The open circuit load limits the secondary current amplitude and, in turn, the rate of change of the secondary current. Therefore, the rate of change of the primary current in principle is larger than the rate of change of the secondary current. Consequently, the approximation given by Eq. (8) is reasonable and justified. Second, the back emf onto the primary is assumed small. This too is reasonable based on the same arguments for Eq. (8). Therefore, the following second assumption is justified $$L_p \frac{\partial i_p(t)}{\partial t} \gg M_{ps} \frac{\partial i_s(t)}{\partial t} \tag{9}$$

Based on these too assumptions, the coupling equations between the primary and secondary are $$v_p(t) = -L_p \frac{\partial i_p(t)}{\partial t} \tag{10a}$$

$$v_s(t) = M_{sp} \frac{\partial i_p(t)}{\partial t} \tag{10b}$$

where the signs are based on the orientations of the voltage and currents in FIG. 15A,B. The signs have no bearing on the final result and therefore are carried as such throughout the analysis.

Since the mutual inductance is not known and since the measured change in primary current is not consistently in phase with the secondary current based on the voltage measurements at the bridge wire posts, an effective primary current is defined as $$\tilde{i}_{epRefOC}(t) = \int^t v_{sRefOC}(t)dt = M_{spRef}\, i_{epRefOC}(t) \tag{11}$$

where $v_{sRefOC}$ is the experimental voltage measured at the bridge wire posts of the detonator [in the absence of the bridge wire] with an open circuit load in the presence of the flux generating primary reference coil. A time independent correction factor is generated to force the overall amplitude of $\tilde{i}_{epRefOC}(t)$ to be equivalent to the overall measured primary current $i_{pmeasRefOC}(t)$. Consequently, $$CF_{RefOC} = \frac{i_{pmeasRefOC}(t)}{\tilde{i}_{epRefOC}(t)} \tag{12}$$

The correction factors varied by about a factor of four or less among all of the scenarios examined. This implies that the correction factor is not very sensitive to the open circuit geometry of the detonator loads examined. Hence, a single average value can be identified as being a representative correction factor for all bridge wire materials with any open circuit load configurations. Therefore, $$M_{psRef} = M_{spRef} = \frac{1}{CF_{RefOC}} \approx \frac{1}{CF_{RefAve}} \tag{13}$$

where the correction factor CF has units of [V−s/A]. Because the back emf from the secondary detonator coil was assumed negligible, both the mutual inductance and the correction factor are independent of the bridge wire type supported by the detonator.

Combining Eqs. (10a) and (10b), the relationship between the primary voltage and the secondary voltage (with open circuit secondary load) is $$v_s(t) = -\frac{M_{sp}}{L_P} v_p(t) \tag{14}$$

Since the effective primary voltage is nearly equal to the primary voltage, the term 'effective' and the subscript 'e' will be omitted from this point forward. Because all measurements are based on the open circuit detonator secondary and a primary circuit with a specific reference primary coil, $v_s(t)=v_{sRefOC}$, $v_p(t)=V_{pRefOC}(t)$, $M_{sp}=M_{spRef}$, and $L_p=L_{pRef}$. With the aid of Eq. (13), Eq. (14) becomes $$v_{sRefOC}(t) = -\frac{M_{spRef}}{L_{pRef}} v_{pRef}(t) \approx -\frac{1}{CF_{RefAve} L_{pRef}} v_{pRef}(t) \quad (15)$$

The correction factor given by Eq. (12) is nearly independent of the type of open circuit detonator load based on the configurations examined.

Assuming the magnetic mediums are linear, Eq. (15) may be extended to wire melt conditions yielding $$v_{sRefMelt}(t) = -\frac{M_{spRef}}{L_{pRef}} v_{pRefMelt}(t) \quad (16a)$$

$$v_{pRefMelt}(t) = -\frac{L_{pRef}}{M_{spRef}} v_{sRefMelt}(t) \quad (16b)$$

where $L_{pRef}/M_{spRef}$ is a constant and $$M_{spRef} \approx \frac{1}{CF_{RefAve}} \quad (17)$$

The approximation in Eq. (17) will not be distinguished in later expressions beyond this point. Equation (16b) provides the voltage condition at the primary coil for wire melt to occur at the bridge wire terminals in terms of the bridge wire voltage driving the current to melt the wire.

The secondary voltage for wire melt is bridge wire dependent and not dependent on the coupling source to drive the conditions. That is, any voltage source with the same signal configuration and duration connected to the bridge wire posts supporting a particular bridge wire will cause the bridge wire to melt. From our short circuit detonator tests, a threshold voltage needed for wire melt at the bridge wire posts in the secondary (detonator) with short circuit load for a particular time duration (roughly about 30 μs consecutively) has been determined. Refer to the shaded conservative thresholds in Table 2. These measurements were obtained with the same primary coil (denoted as the reference coil) used in the open circuit detonator tests. Then, for wire melt to occur in the open circuit detonator, the voltage at the bridge wire posts must have a similar signal shape and duration. Because the detonator loads are different, this is not possible in practice. Since Joule heating is proportionally related to the square of the bridge wire voltage or current, the short circuit threshold voltage should be nearly equivalent to the root mean square of a sinusoidal signal based on the minimum open circuit voltage peak during the time duration of the detonator tests with short circuit load. As a result, $$v_{sRefMelt}(t) \geq v_{SCThreshold} \text{ for } \Delta t_{Refmelt} = 30\ \mu s \text{ consecutively} \quad (18a)$$

implying $$v_{pRefMelt}(t) \geq V_{pRefThreshold} \text{ for } \Delta t_{RefMelt} \approx 30\ \mu s \text{ consecutively} \quad (18b)$$

where $$v_{pRefThreshold} = -\frac{L_{pRef}}{M_{spRef}} v_{SCThreshold} \quad (18c)$$

Here, $v_{SCThreshold} = |V_{emf}|_{1/2}$ is the conservative, bridge wire dependent, voltage needed for detonators to melt with a short circuit load as listed in Table 2.

All scaled versions of the primary circuit must satisfy Eqs. (16a,b) with Eqs. (18a-c) as minimum conditions if melt is to be anticipated. Using the subscript 'New' to represent any new primary circuit design that will lead to wire melt, the following scaling laws may be written $$-v_{sRefMelt}(t) = \frac{M_{spRef}}{L_{pRef}} v_{pRefMelt}(t) = \frac{M_{spNew}}{L_{pNew}} v_{pNewMelt}(t) \quad (19a)$$

$$v_{pNewMelt}(t) = \frac{L_{pNew}}{M_{spNew}} \frac{M_{spRef}}{L_{pRef}} v_{pRefMelt}(t) = -\frac{L_{pNew}}{M_{spNew}} v_{sRefMelt}(t) \quad (19b)$$

where $L_{pNew}$ and $M_{spNew}$ need to be determined and the sign is a consequence of orientation chosen. The designer has complete control over the geometry of the new primary inductor, $L_{pNew}$, and hence its inductance to enhance the design relative to the reference. The difficulty lies in determining the new mutual inductance, $M_{spNew}$, coupling term.

Although Eq. (17) with Table 4 provide a measured value for the mutual inductance, the breakdown of this value in terms of the coupling specifics is unknown since the detonator is treated as a black box. For a worst case scenario, one may assume the number of turns on the detonator to be one. Further, the primary reference inductance is known since it is the apparatus designed. The mutual reference inductance is appropriately related to the ratio of the electromagnetic, electric, and geometric properties of the secondary detonator coil with associated transmission path and the electromagnetic properties of the alternative path of flux. These are typically unknown a priori. At best, only partial information can be deduced or designed towards based on common constraints. Consequently, a general design scaling law for the primary voltage on the new design relative to the reference design is given by $$v_{pNewMelt}(t) = \frac{N_{pNew}}{N_{pRef}} \frac{A_{aNew}}{A_{aRef}} v_{pRefMelt}(t) \approx \frac{N_{pNew}}{N_{pRef}} \frac{A_{aNew}}{A_{pRef}} v_{pRefMelt}(t) \text{ General Design Equation} \quad (20)$$

where $A_{aNew}$, $A_{aRef}$ and $A_{pRef}$ are the flux areas of the alternative path in the new and reference magnetic circuits and the flux area of the primary reference coil; $N_{pNew}$ and $N_{pRef}$ are the number of turns in the new and reference primary coils. This relation is valid for the general case depicted in FIGS. 15A,B where $A_{aRef} \sim A_{pRef}$ since the detonator area is small and nearly nested in the primary coil.

Frequency Dependence of EMF Voltage Transfer to Bridge Wire for a Detonator with an Open Circuit Load and a Short Circuit Load—Model and Detonator Tendencies It was experimentally shown that the open circuit detonator tends to act as a high pass filter. That is, the low frequency components of the primary coil do not tend to generate a measurable voltage at the bridge wire posts. As observed in Eq. (10b), the emf generated at the bridge wire terminals is proportional to the rate of change of the primary current. The low frequency components will have a smaller effect on the coupling voltage compared to the high frequency components. As a result, a simple theory that describes the frequency dependence of the coupling effect was developed based on the inductive coupling model. Instead of treating the emf as a distributed source, it is treated as a lumped source located at an arbitrary point on the line. Because knowledge of the detonator assembly (bridge wire, casing, explosive load, etc.) is not known a priori, knowledge of optimal coupling frequencies may not be as useful as the knowledge of coupling tendencies for a large class of detonators especially if each improvised detonator is potentially different. Within this spirit and the constraints of this effort, we will assume that an open circuit parallel wire line (22 AWG wire with thin rubber coating, 1" long, 2 mm distance of separation, and an air medium separates the wires) is assumed to be connected directly to a bridge wire resistance. The objective of this section is to determine the frequency dependence of the induced voltage (emf) on the line, $V_{emf}$, transferred to the bridge wire. In effect, this may be thought of as a power transport problem with maximum power transfer desired. Here the term coupled and transferred are used synonymously. The energy or voltage transferred to the load is also stated as being coupled to the load.

Using a transmission line theory, the ratio of the bridge wire voltage magnitude to the emf voltage magnitude for the open circuit line case and the short circuit line case at a particular frequency or equivalently wavenumber ($\beta_{OC}$ and $R_{SC}$ respectively) can be expressed as $$\frac{|v_{BWOC}(\beta_{OC})|}{|v_{emf}(\beta_{OC})|_{max}} = \frac{\left[1-\frac{\ell_A}{\ell}\right]|\sin(\beta_{OC}\ell_A)|}{\sqrt{\sin^2(\beta_{OC}\ell)+\left(\frac{Z_0}{R_{BW}}\right)^2\cos^2(\beta_{OC}\ell)}} \tag{21a}$$

$$\frac{|v_{BWSC}(\beta_{SC})|}{|v_{emf}(\beta_{SC})|_{max}} = \frac{\left[1-\frac{\ell_A}{\ell}\right]|\sin(\beta_{SC}\ell_A)|}{\sqrt{\cos^2(\beta_{SC}\ell)+\left(\frac{Z_0}{R_{BW}}\right)^2\sin^2(\beta_{SC}\ell)}} \tag{21b}$$

Here, $l_A$ is the distance from a point on the line to the distance from the detonator load (open or short) to the induced voltage. This is arbitrarily chosen assuming that the induced voltage due to the electromotive force at any point on the line is a constant. The loss of coupling area is also incorporated into the expressions. The electromotive force is a consequence of the change in magnetic field passing normal through a coupling area.

Figure 16A:
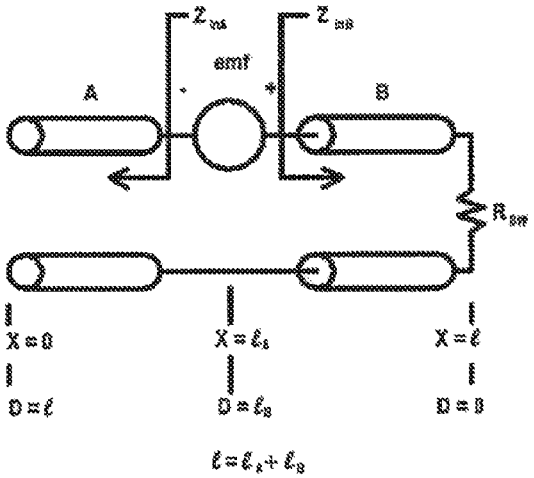
FIG. 16A, B A) Transmission line model of the parallel wire detonator load connected directly to the bridge wire. B) The simple circuit model at the location of the induced emf voltage source.
Figure 16B:
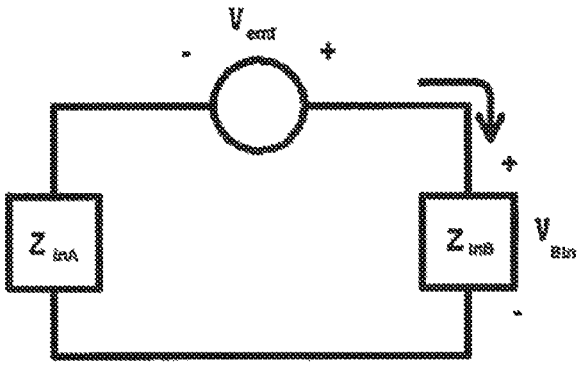

FIG. 16A,B A) Transmission line model of the parallel wire detonator load connected directly to the bridge wire. B) The simple circuit model at the location of the induced emf voltage source.

Figure 17A:
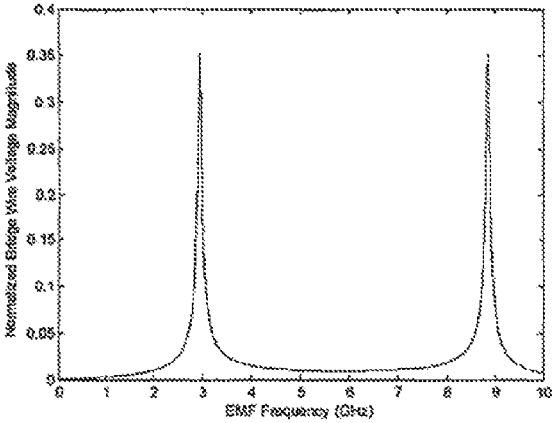
FIG. 17A, B Frequency characteristics on transferring emf energy into a (A) nichrome bridge wire ($R_{BW}$=1.98Ω) and a (B) copper bridge wire ($R_{BW}$=0.0357Ω) when the bridge wire is attached to an open circuit load by way of a 1" long, 2 mm distance of separation, parallel wire line.
Figure 17B:
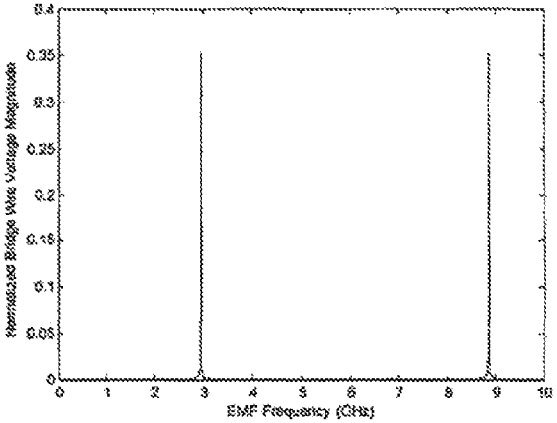

The transmission line parameters of the 1" parallel wire load with a 2 mm distance of separation where partially measured and partially deduced. The measured distributed capacitance, the deduced phase velocity, the calculated distributed inductance and characteristic impedance using $Z_o=\sqrt{\overline{L}/\overline{C}}$ and $v_{ph}=1/\sqrt{\overline{L}\overline{C}}$ yield, respectively, $\overline{C}$=31.5 pF/m, $v_{ph}=3\times10^8$ m/s, $\overline{L}$=0.35 μH/m, and 106Ω. It was deduced that if a wave where to be resonant with the structure, the 1" parallel wire would support a quarter wavelength or a half wavelength at resonance. Therefore, for the phase velocity assumed, the frequency of a quarter wavelength line and a half wavelength line that are 1 inch in length is 2.95 GHz and 5.9 GHz respectively. The bridge wire voltage was determined from Eq. (21a) for a nichrome ($R_{BW}$=1.98Ω) and a copper ($R_{BW}$=0.0357Ω; improvised) bridge wire. The ratio of the characteristic impedance to the bridge wire resistance, $Z_o/R_{BW}$, is large for nichrome and very large for copper. As a result, the coupling to the line at any point will be small when $\beta 3 \ll \pi/2$. At $\beta l=\pi/2$, the ratio of the voltage magnitudes in Eq. (21a) depends on the location of the emf source and is proportional to $|\sin(\beta l_A)|$. Further, it tends to indicate that the more conducting the material is (the smaller the resistance), the smaller the bandwidth about the optimal coupling frequency regardless where the emf source is located. FIGS. 17A,B are based on Eq. (21 a) where the emf is a function of the coupling area illustrates these points. As designed in the expression, emf coupling at the bridge wire is zero since the coupling area contribution is zero. As predicted for the line supporting a wave of quarter of a wavelength based on the line's physical length, the first resonant frequency occurs at slightly less than 3 GHz. The resonant frequency is independent of the bridge wire material as expected from Eq. (21 a). The bandwidth about the resonant frequency is material dependent. Since the length of the open circuit load could be longer (4" implies 738 MHz for quarter wavelength resonance) or shorter (0.5" implies 5.9 GHz for quarter wavelength resonance) than one inch, it might be difficult to strongly couple a narrow bandwidth source to the detonator with open circuit.

Figure 18A:
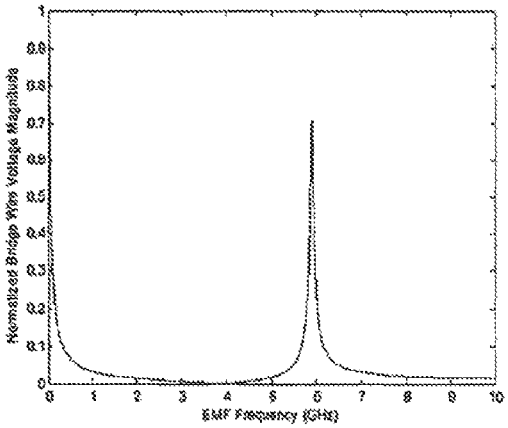
FIG. 18A, B Frequency characteristics on transferring emf energy into a (A) nichrome bridge wire ($R_{BW}$=1.98Ω) and a (B) copper wire ($R_{BW}$=0.0357Ω) when the bridge wire is attached to a short circuit load by way of a 1" long, 2 mm distance of separation, parallel wire line.
Figure 18B:
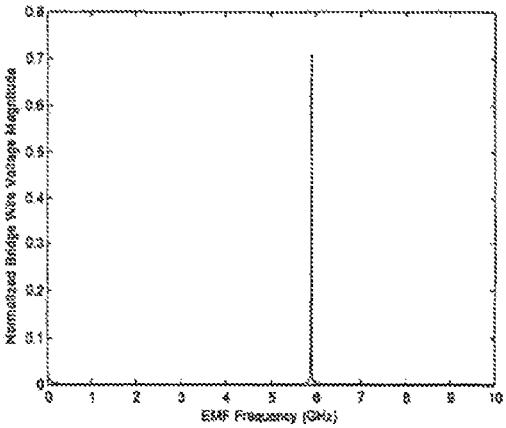

For the same line as treated above for the bridge wire with open circuit load, the short circuit load case was examined based only on Eq. (21b) divided by the coupling area term ($1-[l_A/l]$) for comparison. Refer to FIGS. 18A,B. It is observed in the short circuit load case, that the emf voltage coupled to the load is strongly transferred to the bridge wire at the low frequencies. This is the reason why the short circuit melt case could be accomplished with a low primary source voltage. As the frequency increases, depending on the bridge wire resistance, the coupling to the bridge wire decreases until a resonant condition is encountered at about 6 GHz. Recall that the line supporting a wave with half a wavelength based on the line's physical length, the first resonant frequency also occurs at about 6 GHz. As in the open circuit case, the smaller the bridge wire resistance, the narrower the bandwidth that will allow for strong coupling to the bridge wire. Two processes are occurring. The first is coupling the energy to the secondary and the second transfers this energy to the bridge wire. These observations suggest that pulsed modulation scanned over a suitable high frequency range allows for strong coupling into open circuited detonators by way of resonant and near resonant processes. Primary voltage and current constraints needed for wire melt at the open circuit detonator are significantly decreased allowing for a more manageable detonator defeat system. Furthermore, the low frequency content of the same signal will confound shorted detonators. For a large range of detonator loads, the detonator bridge wire may be compromised.

FIG. 17A,B Frequency characteristics on transferring emf energy into a (A) nichrome bridge wire ($R_{BW}$=1.98Ω) and a (B) copper bridge wire ($R_{BW}$=0.0357Ω) when the bridge wire is attached to an open circuit load by way of a 1" long, 2 mm distance of separation, parallel wire line. The emf is modeled at $l_A$=1.27 cm. Refer to FIG. 16A. The resonant frequencies are independent of the location of the emf source. Strengths will vary based on the coupling area and location of the modeled emf source. Plots are generated from Eq. (21a).

FIG. 18A,B Frequency characteristics on transferring emf energy into a (A) nichrome bridge wire ($R_{BW}$=1.98Ω) and a (B) copper wire ($R_{BW}$=0.0357Ω) when the bridge wire is attached to a short circuit load by way of a 1" long, 2 mm distance of separation, parallel wire line. The emf source is modeled at $l_A$=1.91 cm. Refer to FIG. 16A. The resonant frequency and the strongly coupled low frequencies are independent of the location of the emf source. Strengths will vary based on the coupling area and location of the modeled emf source. Plots are generated from Eq. (21b) divided by the area coupling factor ($1-[l_A/l]$).

VIII. Bridge Wire Melt Experiment Using the Nevada Shocker as a Fast High Voltage Source A 1 MV, 50 ns to 100 ns pulse duration, pulsed power source (Nevada Shocker) is used to generate a pulse stimulus to a coil for open circuit wire melt experiments. Copper and platinum bridge wires were used. Because the pulsed power machine is not matched, the pulse will bounce back and forth in the machine giving the sample under test a number of desired voltage pulses before it decays to zero. Further, because the machine is not matched, it is anticipated that a fair portion of the energy incident on the coil will undesirably be reflected from the coil and therefore not be transmitted to the inductor load. Past experiments have shown multiple pulse durations that extend into the 1 and low 10's of microseconds.

A primary coil voltage of 17.11 MV [60.11 MV] for copper was predicted for the new [reference] coil. PSpice simulations, suggest that the Nevada Shocker will fall short of the maximum voltage by about two orders of magnitude. This is assuming that the maximum signal is to be present for about 30 μs for wire melt. The Nevada Shocker can support an oscillating peak 0.5 MeV voltage signal for about 5 μs. It is anticipated that in another 10 μs, the peak voltage will decrease another 200 or 300 kV. Consequently, the time duration for heating is small for the open circuit detonator. Our experiments fall short of the anticipated conditions needed for wire melt. Since our predictions are conservative, tests were conducted to see if the state of the bridge wire could be changed.

TABLE 5

Experimental studies performed with the new coil in the Nevada Shocker.

| Detonator | $R_{before}$ (Ω) | $R_{after}$ (Ω) | Note |
|---|---|---|---|
| 40 AWG - Cu | 0.036 | 0.081 | First shot |
| 40 AWG - Cu | 0.081 | 0.191 | Same detonator, second shot |

We examined an improvised copper bridge wire. Table 5 provides the resistance measurements of the two experiments before and after being exposed to the time varying flux of the primary coil. The same detonator is used for both shots. The improvised copper wires are not cylindrically symmetric as the military or commercial wire detonators. Therefore, one can expect that localized heating will occur in regions where the cross sectional area of the wire is smaller and at locations where the wire is stretched such as at the bridge wire posts. Here, the copper wire is wrapped around the detonator posts. The approximate factor of two to three change in resistance implies that the copper wire appears to have been heated high enough to begin its irreversible transition to melt when the Nevada Shocker lost is ability to supply more power to continue the process to melt. This tends to imply that that the predicted primary coil voltage may not be too unreasonable keeping in mind that the experiment is not matched and break down (evidenced by a bright flash of light) resulted in an anticipated large loss of energy from reaching the detonator under test.

What is claimed is:

1. An apparatus for the reduction of performance characteristics of a detonator for an explosive device comprising:

a) a source of electromagnetic energy comprising one or more of a capacitor bank or an inductive device;

b) a directional system for transmitting the electromagnetic energy;

c) a control for limiting the electromagnetic energy to a pulse modulated in a frequency and a time;

d) a control for localizing the pulse of the electromagnetic energy; and e) a control for shaping the pulse of the electromagnetic energy, wherein shaping the pulse of the electromagnetic energy comprises adjusting one or more of a pulse width, a duty cycle, a period of repetition, an amplitude, a modulation, a dampening characteristic, a rise time, or a fall time.

2. The apparatus of claim 1, wherein the control for limiting the electromagnetic energy to the pulse is operationally associated with a control for the frequency of the pulse of the electromagnetic energy.

3. The apparatus of claim 2, wherein the control for the frequency of the pulse of the electromagnetic energy comprises a frequency modulator.

4. The apparatus of claim 3, wherein the frequency modulator comprises a laser controlling a mechanical switch or a solid state switch.

5. The apparatus of claim 4, further comprising a control for mixing the pulse of the electromagnetic energy with a signal modulation during a frequency scanning mode.

* * * * *